US008669027B2

(12) United States Patent
Anezaki et al.

(10) Patent No.: US 8,669,027 B2
(45) Date of Patent: Mar. 11, 2014

(54) ELECTROPHOTOGRAPHIC PHOTOSENSITIVE MEMBER, PROCESS CARTRIDGE, ELECTROPHOTOGRAPHIC APPARATUS, AND METHOD OF MANUFACTURING ELECTROPHOTOGRAPHIC PHOTOSENSITIVE MEMBER

(75) Inventors: Takashi Anezaki, Hiratsuka (JP); Kazunori Noguchi, Suntou-gun (JP); Shio Murai, Toride (JP); Kazuhisa Shida, Mishima (JP); Atsushi Okuda, Yokohama (JP); Harunobu Ogaki, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 8 days.

(21) Appl. No.: 13/577,608

(22) PCT Filed: Oct. 5, 2011

(86) PCT No.: PCT/JP2011/073459

§ 371 (c)(1),
(2), (4) Date: Aug. 7, 2012

(87) PCT Pub. No.: WO2012/050143

PCT Pub. Date: Apr. 19, 2012

(65) Prior Publication Data

US 2012/0301182 A1 Nov. 29, 2012

(30) Foreign Application Priority Data

Oct. 14, 2010 (JP) ..... 2010-231812

(51) Int. Cl.
*G03G 5/047* (2006.01)

(52) U.S. Cl.
USPC ..... 430/58.2; 430/133

(58) Field of Classification Search
USPC ..... 430/58.2, 133
See application file for complete search history.

(56) References Cited

U.S. PATENT DOCUMENTS

| | | | |
|---|---|---|---|
| 6,991,881 | B2 | 1/2006 | Ogaki et al. |
| 6,994,941 | B2 | 2/2006 | Tanaka et al. |
| 7,001,699 | B2 | 2/2006 | Tanaka et al. |
| 7,045,261 | B2 | 5/2006 | Tanaka et al. |
| 7,171,142 | B2 | 1/2007 | Kawakami et al. |
| 7,413,840 | B1 | 8/2008 | Ogaki et al. |

(Continued)

FOREIGN PATENT DOCUMENTS

| | | | |
|---|---|---|---|
| JP | 11-279274 | A | 10/1999 |
| JP | 2006-328416 | A | 12/2006 |

(Continued)

OTHER PUBLICATIONS

PCT International Search Report and Written Opinion of the International Searching Authority, International Application No. PCT/JP2011/073459, Mailing Date Dec. 27, 2011.

*Primary Examiner* — Hoa V Le
(74) *Attorney, Agent, or Firm* — Fitzpatrick, Cella, Harper and Scinto

(57) ABSTRACT

The present invention is an electrophotographic photosensitive member including a charge-transporting layer as the surface layer of the electrophotographic photosensitive member having a matrix-domain structure including: a matrix including a component β (at least one resin of a polycarbonate resin C having a specific repeating structural unit and a polyester resin D having a specific repeating structural unit), and γ (charge-transporting substance having a specific structure); and a domain including a component α (polycarbonate resin A having a repeating structural unit containing a specific siloxane moiety).

6 Claims, 1 Drawing Sheet

(56) References Cited

U.S. PATENT DOCUMENTS

| | | | |
|---|---|---|---|
| 7,551,878 | B2 | 6/2009 | Ogaki et al. |
| 7,553,594 | B2 | 6/2009 | Ogaki et al. |
| 7,556,901 | B2 | 7/2009 | Anezaki et al. |
| 7,585,604 | B2 | 9/2009 | Ogaki et al. |
| 7,622,238 | B2 | 11/2009 | Uematsu et al. |
| 7,629,102 | B2 | 12/2009 | Ochi et al. |
| 7,645,547 | B2 | 1/2010 | Okuda et al. |
| 7,655,370 | B2 | 2/2010 | Kitamura et al. |
| 7,704,657 | B2 | 4/2010 | Uesugi et al. |
| 7,718,331 | B2 | 5/2010 | Uematsu et al. |
| 7,749,667 | B2 | 7/2010 | Kawahara et al. |
| 7,799,496 | B2 | 9/2010 | Uesugi et al. |
| 7,838,190 | B2 | 11/2010 | Ogaki et al. |
| 7,875,410 | B2 | 1/2011 | Ogaki et al. |
| 7,901,855 | B2 | 3/2011 | Ogaki et al. |
| 7,927,774 | B2 | 4/2011 | Ogaki et al. |
| 7,931,848 | B2 | 4/2011 | Ochi et al. |
| 2011/0158683 | A1 | 6/2011 | Okuda et al. |
| 2011/0177438 | A1 | 7/2011 | Noguchi et al. |
| 2012/0099898 | A1 | 4/2012 | Ochi et al. |
| 2012/0114375 | A1 | 5/2012 | Fujii et al. |
| 2012/0225381 | A1 | 9/2012 | Nakamura et al. |
| 2012/0301181 | A1 | 11/2012 | Ogaki et al. |
| 2012/0301182 | A1 | 11/2012 | Anezaki et al. |

FOREIGN PATENT DOCUMENTS

| | | | |
|---|---|---|---|
| JP | 2007-79555 | A | 3/2007 |
| WO | 2006/003897 | A1 | 1/2006 |
| WO | 2010/008095 | A1 | 1/2010 |

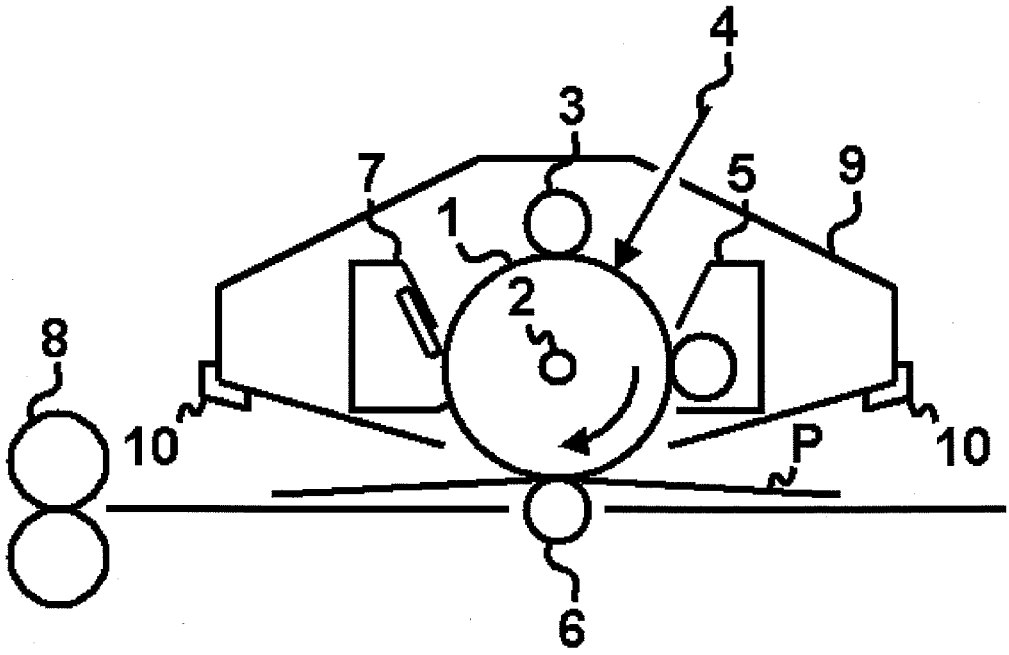
4
3
7
5
9
1
2
8
10
10
P
6

ELECTROPHOTOGRAPHIC PHOTOSENSITIVE MEMBER, PROCESS CARTRIDGE, ELECTROPHOTOGRAPHIC APPARATUS, AND METHOD OF MANUFACTURING ELECTROPHOTOGRAPHIC PHOTOSENSITIVE MEMBER

TECHNICAL FIELD

The present invention relates to an electrophotographic photosensitive member, a process cartridge, an electrophotographic apparatus, and a method of manufacturing an electrophotographic photosensitive member.

BACKGROUND ART

The electrophotographic photosensitive member mounted on electrophotographic apparatuses includes organic electrophotographic photosensitive members (hereinafter, referred to as an "electrophotographic photosensitive member") containing an organic charge-generating substance (organic photoconductive substance). In the electrophotographic process, the surface of the electrophotographic photosensitive member contacts a variety of objects such as a developer, a charging member, a cleaning blade, paper, and a transfer member (hereinafter, referred to as a "contacting member and the like"). For this reason, there has been a demand for reduction in deterioration of image quality caused by contact stress when the electrophotographic photosensitive member contacts the contacting member and the like. Particularly, recently, persistency of a reducing effect on deterioration in image quality caused by the contact stress has been demanded of the electrophotographic photosensitive member as the durability of the electrophotographic photosensitive member is improved.

For continuous relaxation of the contact stress, PTL 1 proposes a method in which using a siloxane resin having a siloxane structure incorporated in the molecular chain, a matrix-domain structure is formed in a surface layer. The disclosure shows that using a polyester resin having a specific siloxane structure incorporated, continuous relaxation of the contact stress can be compatible with potential stability (suppression of fluctuation) when the photoreceptor is repeatedly used.

On the other hand, there has been a proposal that a siloxane modified resin having a siloxane structure in the molecular chain is added to the surface layer of the electrophotographic photosensitive member. PTL 2 proposes an electrophotographic photosensitive member containing a polycarbonate-siloxane copolymerized resin having a specific siloxane structure incorporated, and reports that wear resistance and contamination resistance are improved by introduction of the siloxane structure.

CITATION LIST

Patent Literature

PTL 1: WO 2010/008095

PTL 2: Japanese Patent Application Laid-Open No. 2006-328416

PTL 3: Japanese Patent Application Laid-Open No. 2007-79555

SUMMARY OF INVENTION

Technical Problem

In the electrophotographic photosensitive member disclosed in PTL 1, reduction in the continuous contact stress is compatible with the potential stability in repeating use. As a further examination by the present inventors, however, it was found out that the potential stability in repeating use can be further improved in the case where a charge-transporting substance having a specific structure is used as the charge-transporting substance.

In the electrophotographic photosensitive member disclosed in PTL 2 and containing the resin having an incorporated siloxane structure, the contamination resistance and wear resistance when the photoreceptor is used are improved. The resin having an incorporated siloxane structure and used in PTL 2 has a surface layer formed only with a resin containing a siloxane structure having a crosslinking moiety as a resin component. Accordingly, it was found out that in the resin having an incorporated siloxane structure used in PTL 2, the continuous relaxation of the contact stress is not compatible with the potential stability in repeating use.

Solution to Problem

An object of the present invention is to provide an electrophotographic photosensitive member including a specific charge-transporting substance wherein continuous relaxation of contact stress between the electrophotographic photosensitive member and a contacting member and the like is highly compatible with potential stability in repeating use. Another object of the present invention is to provide a process cartridge having the electrophotographic photosensitive member, and an electrophotographic apparatus. Yet another object of the present invention is to provide a method of manufacturing the electrophotographic photosensitive member.

The objects above are achieved by the present invention below.

The present invention relates to an electrophotographic photosensitive member, comprising: a conductive support, a charge-generating layer which is provided on the conductive support and comprises a charge-generating substance, and a charge-transporting layer which is provided on the charge-generating layer and is a surface layer of the electrophotographic photosensitive member, wherein the charge-transporting layer has a matrix-domain structure having; a domain which comprises a polycarbonate resin A having a repeating structural unit represented by the following formula (A) and a repeating structural unit represented by the following formula (B); and a matrix which comprises, at least one resin selected from the group consisting of a polycarbonate resin C having a repeating structural unit represented by the following formula (C) and a polyester resin D having a repeating structural unit represented by the following formula (D), and at least one charge-transporting substance selected from the group consisting of a compound represented by the following formula (1) and a compound represented by the following formula (1'), wherein the content of a siloxane moiety in the polycarbonate resin A is not less than 5% by mass and not more than 40% by mass relative to the total mass of the polycarbonate resin A.

(A)

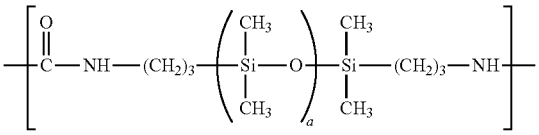

wherein, in the formula (A), "a" represents the number of repetitions of a structure within brackets, and an average of "a" in the polycarbonate resin A ranges from 20 to 200;

(B)

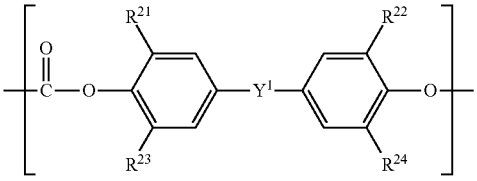

wherein, in the formula (B), $R^{21}$ to $R^{24}$ each independently represent a hydrogen atom or a methyl group; $Y^1$ represents a single bond, a methylene group, an ethylidene group, a propylidene group, a phenylethylidene group, a cyclohexylidene group, or an oxygen atom;

(C)

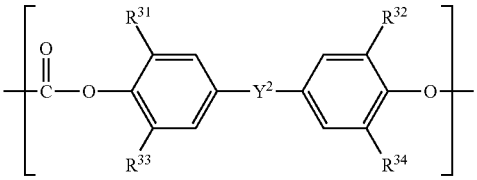

wherein, in the formula (C), $R^{31}$ to $R^{34}$ each independently represent a hydrogen atom or a methyl group; $Y^2$ represents a single bond, a methylene group, an ethylidene group, a propylidene group, a phenylethylidene group, a cyclohexylidene group, or an oxygen atom;

(D)

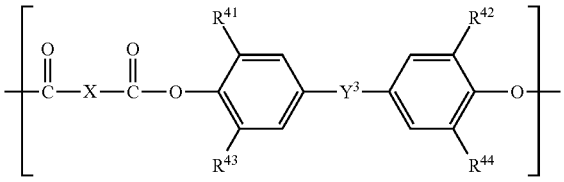

wherein, in the formula (D), $R^{41}$ to $R^{44}$ each independently represent a hydrogen atom or a methyl group; X represents a meta-phenylene group, a para-phenylene group, or a bivalent group having two para-phenylene groups bonded via an oxygen atom; $Y^3$ represents a single bond, a methylene group, an ethylidene group, a propylidene group, a cyclohexylidene group, or an oxygen atom;

(1)

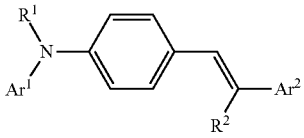

(1')

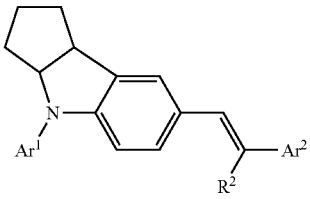

wherein, in the formulae (1) and (1'), $Ar^1$ represents a phenyl group or a phenyl group substituted with a methyl group or an ethyl group; $Ar^2$ represents a phenyl group, a phenyl group substituted with a methyl group, a phenyl group substituted with a univalent group represented by —CH═CH—Ta, or a biphenyl group substituted with a univalent group represented by —CH═CH—Ta (wherein Ta represents a univalent group derived from a benzene ring of a triphenylamine by loss of one hydrogen atom, or a univalent group derived from a benzene ring of a triphenylamine substituted with a methyl group or an ethyl group by loss of one hydrogen atom); $R^1$ represents a phenyl group, a phenyl group substituted with a methyl group, or a phenyl group having a univalent group substituted with —CH═C($Ar^3$)$Ar^4$ (wherein $Ar^3$ and $Ar^4$ each independently represent a phenyl group or a phenyl group substituted with a methyl group); $R^2$ represents a hydrogen atom, a phenyl group, or a phenyl group substituted with a methyl group.

The present invention also relates to a process cartridge detachably attachable to a main body of an electrophotographic apparatus wherein the process cartridge integrally supports the electrophotographic photosensitive member and at least one device selected from the group consisting of a charging device, a developing device, a transferring device, and a cleaning device.

The present invention also relates to an electrophotographic apparatus including the electrophotographic photosensitive member, a charging device, an exposing device, a developing device, and a transferring device.

The present invention also relates to a method of manufacturing the electrophotographic photosensitive member wherein the method includes a step of applying a coating solution for a charge-transporting layer containing the polycarbonate resin A, at least one resin selected from the group consisting of the polycarbonate resin C and the polyester resin D, and at least one charge-transporting substance selected from the group consisting of a compound represented by the formula (1) and a compound represented by the formula (1') onto the charge-generating layer, and drying the coating solution to form a charge-transporting layer.

Advantageous Effects Of Invention

The present invention can provide an electrophotographic photosensitive member including a specific charge-transporting substance wherein continuous relaxation of contact stress between the electrophotographic photosensitive member and a contacting member and the like is highly compatible with potential stability in repeating use. The present invention can also provide a process cartridge having the electrophotographic photosensitive member, and an electrophotographic apparatus. The present invention can also provide a method of manufacturing the electrophotographic photosensitive member.

Further features of the present invention will become apparent from the following description of exemplary embodiments with reference to the attached drawings.

BRIEF DESCRIPTION OF DRAWINGS

FIG. 1 is a drawing illustrating an example of a schematic configuration of an electrophotographic apparatus including a process cartridge having an electrophotographic photosensitive member according to the present invention.

DESCRIPTION OF EMBODIMENTS

Hereinafter, a polycarbonate resin A having the repeating structural unit represented by the formula (A) and the repeating structural unit represented by the formula (B) is referred to as a component α. At least one resin selected from a polycarbonate resin C having the repeating structural unit represented by the formula (C) and a polyester resin D having the repeating structural unit represented by the formula (D) is referred to as a component β. At least one charge-transporting substance of compounds represented by the formulas (1) and (1') is referred to as a component γ.

The electrophotographic photosensitive member according to the present invention includes a conductive support, a charge-generating layer provided on the conductive support, and a charge-transporting layer which is provided on the charge-generating layer, and is a surface layer of the electrophotographic photosensitive member, wherein the charge-transporting layer has a matrix-domain structure having a matrix including the components β and γ and a domain including the component α, as described above.

In the matrix-domain structure in the present invention, the matrix corresponds to a sea, and the domain corresponds to an island in a "sea island structure." The domain including the component α represents a granular (island-like) structure formed in the matrix including the components β and γ. In the domain including the component α, the domains independently exist in the matrix. Such a matrix-domain structure can be recognized by observation of the surface of the charge-transporting layer or the cross section of the charge-transporting layer.

Observation of the state of the matrix-domain structure or measurement of the domain can be performed using a commercially available laser microscope, optical microscope, electron microscope, or atomic force microscope, for example. Using the microscope, observation of the state of the matrix-domain structure or measurement of the domain can be performed at a predetermined magnification.

The number average particle size of the domain including the component α in the present invention is preferably not less than 100 nm and not more than 1,000 nm. Narrower particle size distribution of the particle size of each domain is preferable from the viewpoint of persistency of a relaxing effect on the contact stress. The number average particle size in the present invention is obtained as follows: 100 domains are arbitrarily selected from the domains observed by the microscope in a vertical cross section of the charge-transporting layer of the present invention. The largest diameters of the cut domains are measured, and averaged to calculate the number average particle size of the domain. By observation of the cross section of the charge-transporting layer with the microscope, the image information in the depth direction can be obtained, and a three-dimensional image of the charge-transporting layer can be obtained.

In order to form the matrix-domain structure in the present invention, the content of the siloxane moiety in the polycarbonate resin A as the component α is preferably not less than 1% by mass and not more than 20% by mass relative to the total mass of whole resins in the charge-transporting layer. From the viewpoint of compatibility of the continuous relaxation of the contact stress with the potential stability in repeating use, the content of the siloxane moiety in the polycarbonate resin A as the component α is also preferably not less than 1% by mass and not more than 20% by mass relative to the total mass of the whole resins in the charge-transporting layer. More preferably, at a content of not less than 2% by mass and not more than 10% by mass, the continuous relaxation of the contact stress and the potential stability in repeating use can be further enhanced.

The matrix-domain structure of the charge-transporting layer of the electrophotographic photosensitive member according to the present invention can be formed using a coating solution for a charge-transporting layer containing the components α, β and γ. Then, the coating solution for a charge-transporting layer is applied onto the charge-generating layer, and dried. Thereby, the electrophotographic photosensitive member according to the present invention can be manufactured.

The matrix-domain structure in the present invention is a structure in which the domain including the component α is formed in the matrix including the components β and γ. It is thought that the domain including the component α is formed not only on the surface of the charge-transporting layer but also inside of the charge-transporting layer, and thereby the contact stress relaxation effect is persistently demonstrated. Specifically, it is thought that the siloxane resin component having the contact stress relaxation effect reduced by friction with the member such as paper and the cleaning blade can be supplied from the domains in the charge-transporting layer.

The present inventors found out that in the case where a specific charge-transporting substance is used as the charge-transporting substance, the potential stability in repeating use can be further improved. Moreover, the present inventors presume the reason that the potential stability in repeating use is further enhanced in the electrophotographic photosensitive member according to the present invention containing a specific charge-transporting substance (component γ) as follows.

In the electrophotographic photosensitive member according to the present invention having the charge-transporting layer having the matrix-domain structure, in order to suppress the potential fluctuation in repeating use, it is important to reduce the content of the charge-transporting substance in the domain in the formed matrix-domain structure as much as possible. In the case where the charge-transporting substance has high compatibility with the resin that forms the domain and has a siloxane structure incorporated, a larger amount of the charge-transporting substance is contained in the domain, charges are captured by the charge-transporting substance in the domain during repeating use of the photoreceptor, leading to insufficient potential stability.

In the electrophotographic photosensitive member including a specific charge-transporting substance, improvement of properties is necessary by a resin having a siloxane structure incorporated for compatibility of the potential stability in repeating use with the persistent relaxing effect on the contact stress. The component γ in the present invention is a charge-transporting substance having high compatibility with the resin in the charge-transporting layer, and it is thought that the siloxane-containing resin undesirably contains a large amount of component γ in the domain, and the component γ is easily aggregated.

In the present invention, the domain including the component α of the present invention is formed in the electrophotographic photosensitive member including the component γ. Thereby, a high charge-transporting ability can be kept. It is thought that the reason is that formation of the domain including the component α reduces the content of the component γ (specific charge-transporting substance) in the domain. It is thought that the reason is that the siloxane structure in the polycarbonate resin A as the component α can reduce the component γ having a structure easily compatible with the resin that remains in the domain.

<About Component γ>

The component γ in the present invention is at least one charge-transporting substance selected from the compounds represented by the following formulas (1) and (1'):

(1)

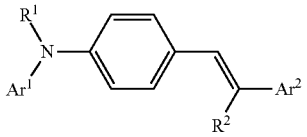

-continued (1')

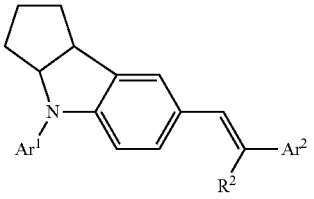

wherein $Ar^1$ represents a phenyl group, or a phenyl group substituted with a methyl group or an ethyl group; $Ar^2$ represents a phenyl group, a phenyl group substituted with a methyl group, a phenyl group substituted with a univalent group represented by —CH═CH—Ta, or a biphenyl group substituted with a univalent group represented by —CH═CH—Ta (wherein Ta represents a univalent group derived from a benzene ring of a triphenylamine by loss of one hydrogen atom, or a univalent group derived from a benzene ring of a triphenylamine substituted with a methyl group or an ethyl group by loss of one hydrogen atom); $R^1$ represents a phenyl group, a phenyl group substituted with a methyl group, or a phenyl group having a univalent group substituted with —CH═C($Ar^3$)$Ar^4$ (wherein $Ar^3$ and $Ar^4$ each independently represent a phenyl group or a phenyl group substituted with a methyl group); $R^2$ represents a hydrogen atom, a phenyl group, or a phenyl group substituted with a methyl group.

Hereinafter, specific examples of the component [γ], i.e., the charge-transporting substances represented by the above formulas (1) and (1') will be shown:

(1-1)

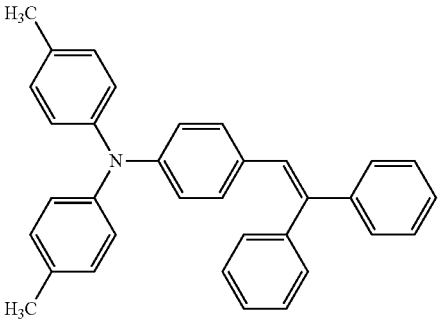

(1-2)

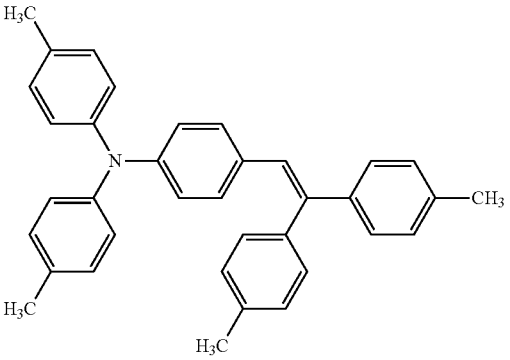

(1-3)

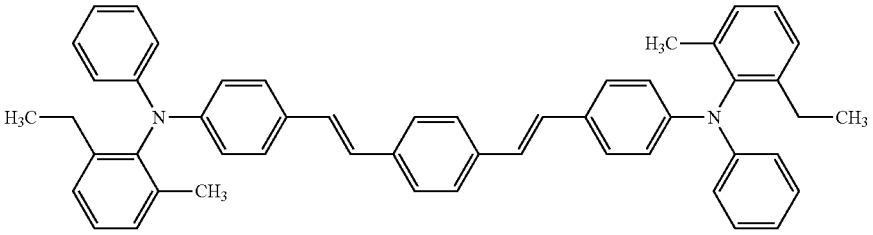

-continued (1-4)

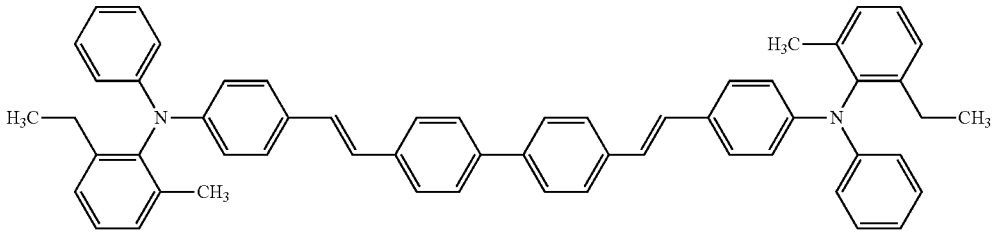

(1-5)

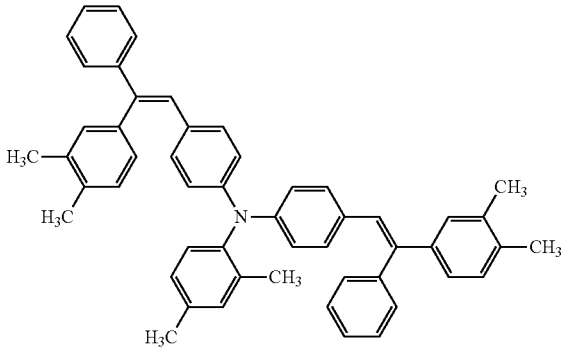

(1-6)

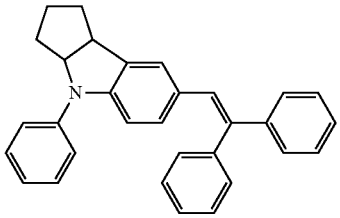

(1-7)

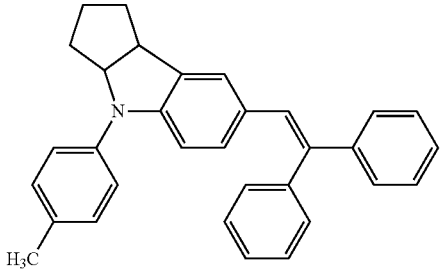

(1-8)

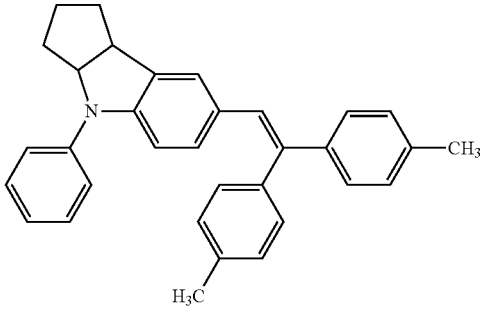

(1-9)

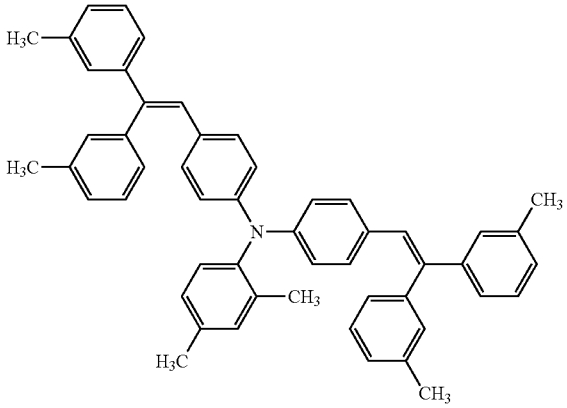

(1-10)

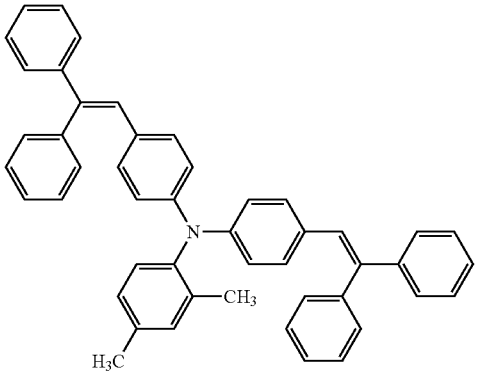

Among these, the component γ is preferably a charge-transporting substance having a structure represented by the above formulas (1-1), (1-3), (1-5), and (1-7).

<About Component α>

The component α in the present invention is a polycarbonate resin A having the repeating structural unit represented by the following formula (A) and the repeating structural unit represented by the following formula (B). The content of siloxane moiety in the polycarbonate resin A is not less than 5% by mass and not more than 40% by mass:

(A)

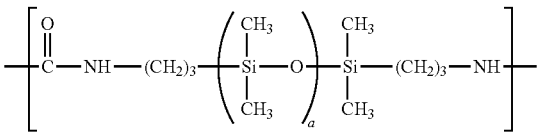

wherein "a" represents the number of repetitions of a structure within brackets, and an average of "a" in the polycarbonate resin A ranges from 20 to 200;

(B)

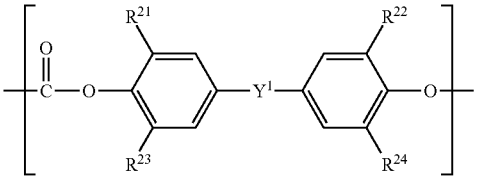

wherein $R^{21}$ to $R^{24}$ each independently represent a hydrogen atom or a methyl group; $Y^1$ represents a single bond, a methylene group, an ethylidene group, a propylidene group, a phenylethylidene group, a cyclohexylidene group, or an oxygen atom.

Hereinafter, the component α, i.e., the polycarbonate resin A having the above repeating structural unit represented by the formula (A) and the above repeating structural unit represented by the formula (B) will be described.

"a" in the above formula (A) represents the number of repetitions of the structure within the brackets, and an average of "a" in the polycarbonate resin A ranges from 20 to 200. More preferably, "a" is not less than 30 and not more than 100 from the viewpoint of compatibility of the continuous contact stress relaxation with the potential stability in repeating use. Preferably, the number of repetitions "a" of the structure within the brackets in each repeating structural unit is within the range of ±10% of the value shown as the average of the number of repetitions "a" because the effect of the present invention is stably obtained.

In Table 1, examples of the above repeating structural unit represented by the formula (A) will be shown.

TABLE 1

| Repeating structural unit represented by formula (A) | Average of "a" |
|---|---|
| Repeating structural unit example (A-1) | 40 |
| Repeating structural unit example (A-2) | 60 |
| Repeating structural unit example (A-3) | 80 |
| Repeating structural unit example (A-4) | 100 |
| Repeating structural unit example (A-5) | 30 |
| Repeating structural unit example (A-6) | 20 |
| Repeating structural unit example (A-7) | 150 |
| Repeating structural unit example (A-8) | 200 |

Among these, the repeating structural units represented by the above formulas (A-1), (A-2), (A-3), (A-4), and (A-5) are preferable.

Next, the above repeating structural unit represented by the formula (B) will be described. Hereinafter, specific examples of the above repeating structural unit represented by the formula (B) will be shown:

(B-1)

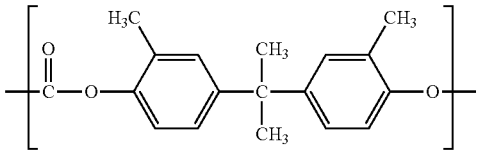

-continued (B-2)

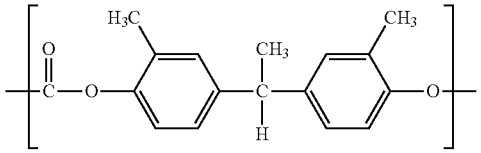

(B-3)

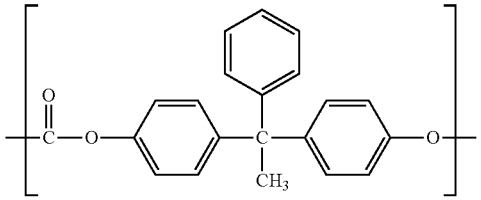

(B-4)

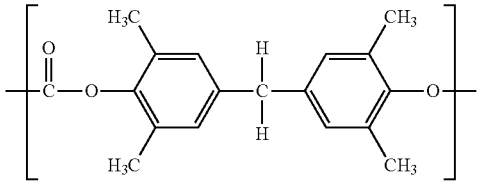

(B-5)

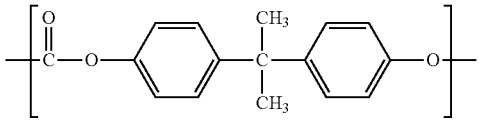

(B-6)

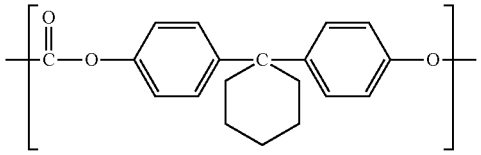

(B-7)

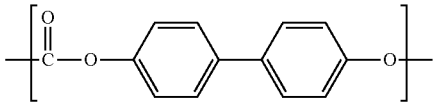

(B-8)

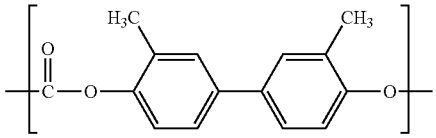

(B-9)

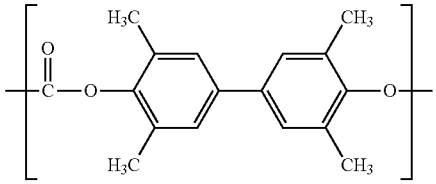

(B-10)

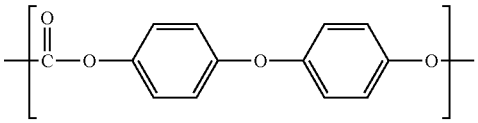

Among these, the repeating structural units represented by the above formulas (B-1), (B-2), (B-7), (B-8), (B-9), and (B-10) are preferable.

The polycarbonate resin A as the component α in the present invention contains not less than 5% by mass and not more than 40% by mass of a siloxane moiety relative to the total mass of the polycarbonate resin A.

In the present invention, the siloxane moiety is a moiety including silicon atoms on both ends that form a siloxane portion, a group boned to the silicon atoms, an oxygen atom, a silicon atom, and a group bonded thereto between the silicon atoms on the ends. Specifically, in the present invention, the siloxane moiety refers to a moiety surrounded by the dashed line below in the case of the repeating structural unit represented by the following formula (A-S):

(A-S)

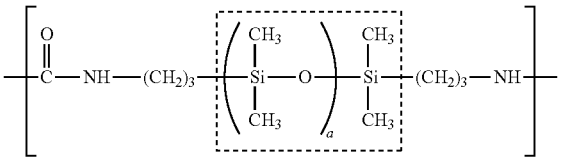

Namely, the structural formula shown below is the siloxane moiety:

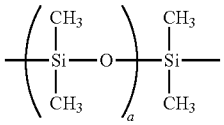

Siloxane moiety

If the content of the siloxane moiety relative to the total mass of the polycarbonate resin A as the component α in the present invention is less than 5% by mass, a persistent reducing effect on the contact stress cannot be sufficiently obtained, and the domain cannot be efficiently formed in the matrix including the components β and γ. If the content of the siloxane moiety is more than 40% by mass, the component γ is aggregated in the domain including the component α, and the potential stability in repeating use cannot be sufficiently obtained.

The content of the siloxane moiety relative to the total mass of the polycarbonate resin A as the component α in the present invention can be analyzed by an ordinary analyzing method. Hereinafter, an example of the analyzing method will be shown.

First, the charge-transporting layer as the surface layer of the electrophotographic photosensitive member is dissolved by a solvent. Subsequently, using an fractionating apparatus that can separate and recover each composition component such as a size exclusion chromatograph and a high performance liquid chromatograph, a variety of materials contained in the charge-transporting layer as the surface layer are fractionated. The fractionated polycarbonate resin A as the component α is subjected to $^1$H-NMR measurement. Using a conversion method using the peak position and the ratio of the peak area of the hydrogen atom (hydrogen atom that forms the resin) obtained by the $^1$H-NMR measurement, the structure and content of the material that forms the resin can be recognized. From those results, the number of repetitions of the siloxane moiety and the molar ratio are calculated, and converted into the content (mass ratio). Alternatively, the fractionated polycarbonate resin A as the component α is hydrolyzed in the presence of an alkali, and decomposed into a carboxylic acid portion and a bisphenol portion. The obtained bisphenol portion is subjected to nuclear magnetic resonance spectrum analysis or mass spectrometry. The number of repetitions of the siloxane moiety and the molar ratio are calculated, and converted into the content (mass ratio).

In the present invention, the mass ratio of the siloxane moiety contained in the polycarbonate resin A as the component α was measured using the method above.

The polycarbonate resin A as the component α used in the present invention is a copolymer of the repeating structural unit represented by the above formula (A) and the repeating structural unit represented by the above formula (B). The form of copolymerization may be any form such as block copolymerization, random copolymerization, and alternating copolymerization.

The weight-average molecular weight of the polycarbonate resin A as the component α used in the present invention is preferably not less than 30,000 and not more than 150,000 from the viewpoint of formation of the domain in the matrix containing the components β and γ. The weight-average molecular weight is more preferably not less than 40,000 and not more than 100,000.

In the present invention, the weight-average molecular weight of the resin is a weight-average molecular weight in terms of polystyrene measured by a method described in PTL 3 according to the standard method.

The polycarbonate resin A as the component α used in the present invention can be synthesized by the conventional phosgene method, for example. The polycarbonate resin A can also be synthesized by transesterification.

Hereinafter, a synthesis example of the polycarbonate resin A as the component α used in the present invention will be shown.

The polycarbonate resin A can be synthesized by a method described in PTL 2. In the present invention, using the same synthesis method, the component α (polycarbonate resin A) shown in Synthesis Example in Table 2 was synthesized using materials corresponding to the above repeating structural unit represented by the formula (A) and those corresponding to the above repeating structural unit represented by the formula (B). The weight-average molecular weight of the synthesized polycarbonate resin A and the content of the siloxane moiety of the polycarbonate resin A are shown in Table 2.

TABLE 2

| | Component [α] (polycarbonate resin A) | Repeating structural unit represented by formula (A) | Repeating structural unit represented by formula (B) | Weight-average molecular weight | Content of siloxane moiety in polycarbonate resin A (% by mass) |
|---|---|---|---|---|---|
| Synthesis example 1 | Resin A (1) | (A-1) | (B-1) | 60,000 | 40 |
| Synthesis example 2 | Resin A (2) | (A-1) | (B-1) | 60,000 | 30 |
| Synthesis example 3 | Resin A (3) | (A-1) | (B-1) | 70,000 | 20 |
| Synthesis example 4 | Resin A (4) | (A-1) | (B-1) | 50,000 | 10 |

TABLE 2-continued

| | Component [α] (polycarbonate resin A) | Repeating structural unit represented by formula (A) | Repeating structural unit represented by formula (B) | Weight-average molecular weight | Content of siloxane moiety in polycarbonate resin A (% by mass) |
|---|---|---|---|---|---|
| Synthesis example 5 | Resin A (5) | (A-1) | (B-3)/(B-5) = 5/5 | 60,000 | 20 |
| Synthesis example 6 | Resin A (6) | (A-1) | (B-5)/(B-7) = 8/2 | 40,000 | 20 |
| Synthesis example 7 | Resin A (7) | (A-1) | (B-6)/(B-7) = 7/3 | 50,000 | 20 |
| Synthesis example 8 | Resin A (8) | (A-1) | (B-10) | 40,000 | 20 |
| Synthesis example 9 | Resin A (9) | (A-2) | (B-2) | 60,000 | 30 |
| Synthesis example 10 | Resin A (10) | (A-2) | (B-2) | 60,000 | 20 |
| Synthesis example 11 | Resin A (11) | (A-2) | (B-5)/(B-7) = 8/2 | 50,000 | 20 |
| Synthesis example 12 | Resin A (12) | (A-2) | (B-6)/(B-10) = 8/2 | 50,000 | 5 |
| Synthesis example 13 | Resin A (13) | (A-3) | (B-1) | 70,000 | 30 |
| Synthesis example 14 | Resin A (14) | (A-3) | (B-6)/(B-10) = 8/2 | 60,000 | 10 |
| Synthesis example 15 | Resin A (15) | (A-4) | (B-1)/(B-8) = 8/2 | 60,000 | 5 |
| Synthesis example 16 | Resin A (16) | (A-4) | (B-1)/(B-4) = 7/3 | 40,000 | 20 |
| Synthesis example 17 | Resin A (17) | (A-5) | (B-1) | 60,000 | 40 |
| Synthesis example 18 | Resin A (18) | (A-5) | (B-1)/(B-9) = 8/2 | 40,000 | 20 |
| Synthesis example 19 | Resin A (19) | (A-6) | (B-5)/(B-7) = 8/2 | 70,000 | 20 |
| Synthesis example 20 | Resin A (20) | (A-6) | (B-5)/(B-7) = 8/2 | 50,000 | 40 |
| Synthesis example 21 | Resin A (21) | (A-7) | (B-1)/(B-8) = 8/2 | 70,000 | 30 |
| Synthesis example 22 | Resin A (22) | (A-7) | (B-1)/(B-8) = 8/2 | 60,000 | 5 |
| Synthesis example 23 | Resin A (23) | (A-8) | (B-3)/(B-5) = 5/5 | 70,000 | 20 |
| Synthesis example 24 | Resin A (24) | (A-8) | (B-6)/(B-10) = 8/2 | 50,000 | 10 |

In the repeating structural unit example (A-1), the maximum number of repetitions "a" within the brackets was 43, and the minimum number thereof was 38. In the repeating structural unit example (A-6), the maximum number of repetitions "a" within the brackets was 22, and the minimum number thereof was 18. In the repeating structural unit example (A-8), the maximum number of repetitions "a" within the brackets was 210, and the minimum number thereof was 190.

<About Component β>

The component β in the present invention is at least one resin selected from the polycarbonate resin C having the repeating structural unit represented by the following formula (C) and the polyester resin D having the repeating structural unit represented by the following formula (D):

(C)

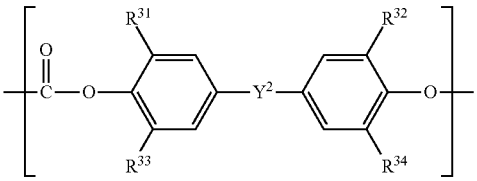

wherein $R^{31}$ to $R^{34}$ each independently represent a hydrogen atom or a methyl group; $Y^2$ represents a single bond, a methylene group, an ethylidene group, a propylidene group, a phenylethylidene group, a cyclohexylidene group, or an oxygen atom;

(D)

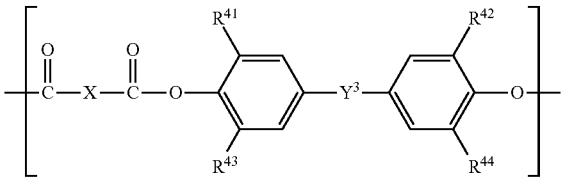

wherein $R^{41}$ to $R^{44}$ each independently represent a hydrogen atom or a methyl group; X represents a meta-phenylene group, a para-phenylene group, or a bivalent group having two para-phenylene groups bonded via an oxygen atom; $Y^3$ represents a single bond, a methylene group, an ethylidene group, a propylidene group, a cyclohexylidene group, or an oxygen atom.

Hereinafter, specific examples of the above repeating structural unit represented by the formula (C) will be shown:

(C-1)

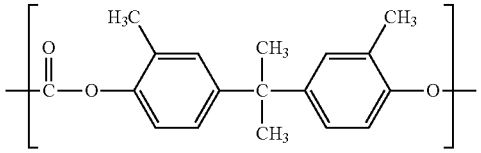

(C-2)

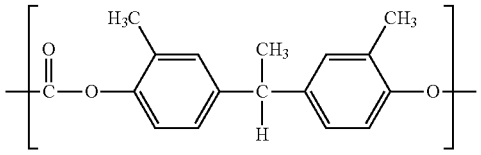

(C-3)

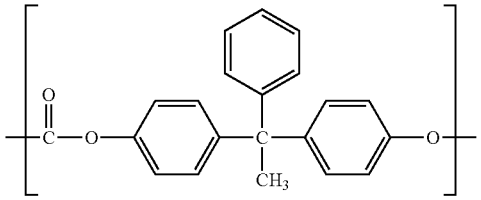

(C-4)

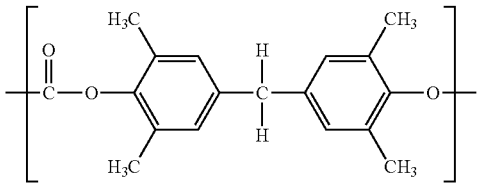

-continued (C-5)

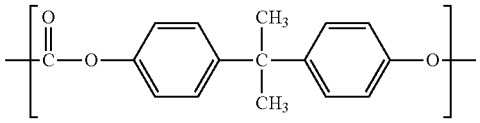

(C-6)

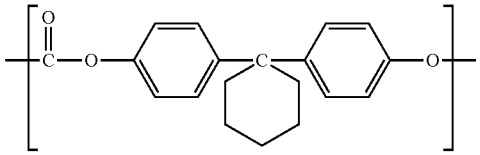

(C-7)

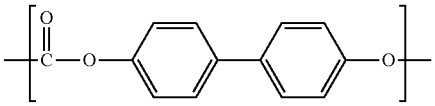

(C-8)

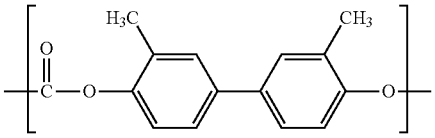

(C-9)

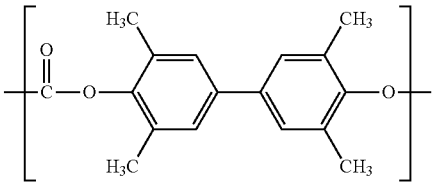

(C-10)

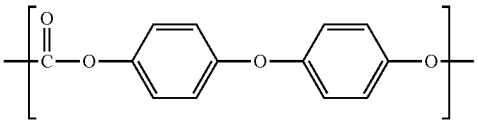

Among these, the repeating structural units represented by the above formulas (C-1), (C-2), (C-7), (C-8), (C-9), and (C-10) are preferable.

Hereinafter, specific examples of the above repeating structural unit represented by the formula (D) will be shown:

(D-1)

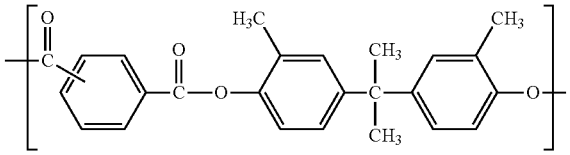

(D-2)

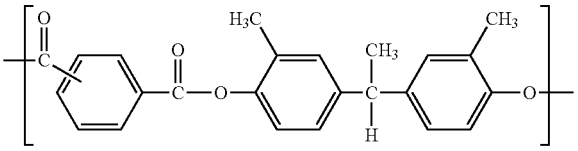

-continued (D-3)

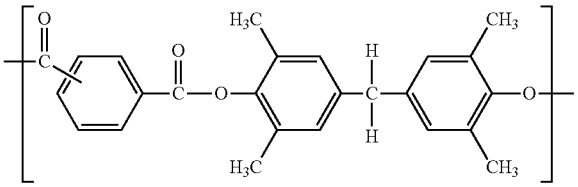

(D-4)

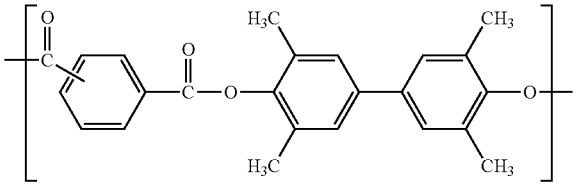

(D-5)

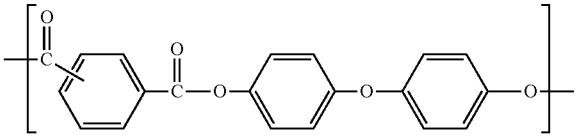

(D-6)

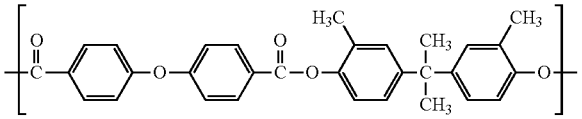

(D-7)

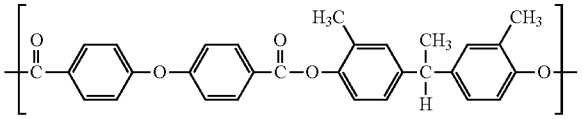

Among these, the repeating structural units represented by the above formulas (D-1), (D-2), (D-6), and (D-7) are preferable. Preferably, the β has no siloxane moiety from the viewpoint of formation of a uniform matrix with the charge-transporting substance.

The charge-transporting layer as the surface layer of the electrophotographic photosensitive member according to the present invention contains the components α and β as the resins, and another resin may be additionally mixed and used. Examples of the another resin that may be mixed and used include acrylic resins, polyester resins, and polycarbonate resins. In the case where another resin is mixed and used, the proportion of the component β to the another resin is preferably in the range of not less than 90% by mass to less than 100% by mass. In the present invention, in the case where another resin is mixed and used in addition to the component β (the polycarbonate resin C or the polyester resin D), a resin having no siloxane structure is preferably used as the another resin from the viewpoint of formation of a uniform matrix with the charge-transporting substance.

The charge-transporting layer as the surface layer of the electrophotographic photosensitive member according to the present invention contains the component γ as the charge-transporting substance, and may contain a charge-transporting substance having a different structure. Examples of the charge-transporting substance having a different structure that may be contained include triarylamine compounds and hydrazone compounds. Among these, use of the triarylamine compounds as the charge-transporting substance is preferable from the viewpoint of the potential stability in repeating use. In the case where the charge-transporting substance other than the component γ is mixed and used, not less than 50% by mass of the component γ is preferably contained in all the charge-transporting substances contained in the charge-transporting layer. More preferably, not less than 70% by mass of the component γ is contained.

Next, a configuration of the electrophotographic photosensitive member according to the present invention will be described.

The electrophotographic photosensitive member according to the present invention is an electrophotographic photosensitive member including a conductive support, a charge-generating layer provided on the conductive support, and a charge-transporting layer provided on the charge-generating layer. In the electrophotographic photosensitive member, the charge-transporting layer is the surface layer (topmost layer) of the electrophotographic photosensitive member.

The charge-transporting layer of the electrophotographic photosensitive member according to the present invention contains the components α, β and γ.

The charge-transporting layer may have a laminate structure. In this case, at least the charge-transporting layer on the topmost surface side has the matrix-domain structure.

As the electrophotographic photosensitive member, usually, a cylindrical electrophotographic photosensitive member obtained by forming a photosensitive layer (charge-generating layer, charge-transporting layer) on a cylindrical conductive support is widely used; a belt-like or sheet-like electrophotographic photosensitive member can be used.

[Conductive Support]

As the conductive support used in the present invention, those having conductivity (conductive support) are preferable, and examples thereof include aluminum and aluminum alloys. In the case of an aluminum or aluminum alloy conductive support, an ED tube, an EI tube, and those subjected to machining, electrochemical mechanical polishing, and wet or dry honing can be used. Examples of the conductive support also include those having a thin film of a conductive material such as aluminum, aluminum alloys, or indium oxide-tin oxide alloys on a metallic conductive support or a resin conductive support.

In order to suppress interference fringes, the surface of the conductive support is preferably roughened properly. Specifically, preferable is use of a conductive support whose surface is subjected to honing, blasting, machining, or electropolishing or an aluminum or aluminum alloy conductive support having a conductive layer containing a conductive metal-oxide particle and a resin on the conductive support. In order to suppress interference fringes produced in an output image by interference of the light reflected on the conductive layer surface, a surface roughening material for roughening the surface of the conductive layer can be added.

In the electrophotographic photosensitive member according to the present invention, a conductive layer having a conductive particle and a resin may be provided on the conductive support. By a method for forming the conductive layer having a conductive particle and a resin on the conductive support, a powder containing a conductive particle in the conductive layer is contained. Examples of the conductive particle include carbon black, acetylene black, powders of metals such as aluminum, nickel, iron, nichrome, copper, zinc, silver, and powders of metal oxides such as conductive tin oxide and ITO.

Examples of the resin used for the conductive layer include polyester resins, polycarbonate resins, polyvinyl butyral resins, acrylic resins, silicone resins, epoxy resins, melamine resins, urethane resins, phenol resins, and alkyd resins. These resins may be used alone, or two or more thereof may be used in combination.

The conductive layer can be formed by dip coating or solvent coating by a Meyer bar. Examples of a solvent for a coating solution for a conductive layer include ether solvents, alcohol solvents, ketone solvents, and aromatic hydrocarbon solvents.

The film thickness of the conductive layer is preferably not less than 0.2 μm and not more than 40 μm, more preferably not less than 1 μm and not more than 35 μm, and still more preferably not less than 5 μm and not more than 30 μm.

[Intermediate Layer]

In the electrophotographic photosensitive member according to the present invention, an intermediate layer may be provided between the conductive support or conductive layer and the charge-generating layer.

The intermediate layer can be formed as follows: a coating solution for an intermediate layer containing a resin is applied onto the conductive layer, and dried or cured.

Examples of the resin used for the intermediate layer include polyacrylic acids, methyl cellulose, ethyl cellulose, polyamide resins, polyimide resins, polyamideimide resins, polyamic acid resins, melamine resins, epoxy resins, and polyurethane resins. As the resin used for the intermediate layer, the thermoplastic resins are preferable, and the thermoplastic polyamide resins are preferable. As the polyamide resin, preferable are low crystalline or non-crystalline copolymerized nylons that can be applied in a solution state.

The film thickness of the intermediate layer is preferably not less than 0.05 μm and not more than 40 μm, and more preferably not less than 0.1 μm and not more than 7 μm.

The intermediate layer may contain a semi-conductive particle, an electron-transporting substance, or an electron receptive substance.

[Charge-Generating Layer]

In the electrophotographic photosensitive member according to the present invention, a charge-generating layer is provided on the conductive support, the conductive layer, or the intermediate layer.

Examples of the charge-generating substance used for the electrophotographic photosensitive member according to the present invention include azo pigments, phthalocyanine pigments, indigo pigments, and perylene pigments. One or two or more of these charge-generating substances may be used. Among these, particularly preferable are oxytitanium phthalocyanine, hydroxy gallium phthalocyanine, and chlorogallium phthalocyanine for their high sensitivity.

Examples of the resin used for the charge-generating layer include polycarbonate resins, polyester resins, butyral resins, polyvinyl acetal resins, acrylic resins, vinyl acetate resins, and urea resins. Among these, butyral resins are particularly preferable. These can be used alone, or two or more thereof can be mixed, or used as a copolymer.

The charge-generating layer can be formed as follows: a coating solution for a charge-generating layer obtained by dispersing the charge-generating substance, the resin, and a solvent is applied, and dried. The charge-generating layer may be a deposited film of the charge-generating substance.

Examples of a dispersion method include methods using a homogenizer, an ultrasonic wave, a ball mill, a sand mill, an Attritor, and a roll mill.

As the proportion of the charge-generating substance to the resin, the charge-generating substance is preferably not less than 0.1 parts by mass and not more than 10 parts by mass, and particularly more preferably not less than 1 part by mass and not more than 3 parts by mass based on 1 part by mass of the resin.

Examples of the solvent used for the coating solution for a charge-generating layer include alcohol solvents, sulfoxide solvents, ketone solvents, ether solvents, ester solvents, and aromatic hydrocarbon solvents.

The film thickness of the charge-generating layer is preferably not less than 0.01 μm and not more than 5 μm, and more preferably not less than 0.1 μm and not more than 2 μm.

A variety of sensitizers, antioxidants, ultraviolet absorbing agents, and plasticizers can be added to the charge-generating layer when necessary. In order to prevent clogging of a flow of charges in the charge-generating layer, the charge-generating layer may contain an electron transport substance or an electron receptive substance.

[Charge-Transporting Layer]

In the electrophotographic photosensitive member according to the present invention, a charge-transporting layer is provided on the charge-generating layer. The charge-transporting layer as the surface layer of the electrophotographic photosensitive member according to the present invention contains the component γ as the specific charge-transporting substance, and may contain a charge-transporting substance having a different structure as described above. The charge-transporting substance having a different structure that may be mixed is as described above.

The charge-transporting layer as the surface layer of the electrophotographic photosensitive member according to the present invention contains the components α and β as the resin, and as described above, another resin may be mixed and used. The another resin that may be mixed and used is as described above.

The charge-transporting layer can be formed as follows: a coating solution for a charge-transporting layer obtained by dissolving the charge-transporting substance and the respective resins in a solvent is applied, and dried.

As the proportion of the charge-transporting substance to the resin, the charge-transporting substance is preferably not less than 0.4 parts by mass and not more than 2 parts by mass, and more preferably not less than 0.5 parts by mass and not more than 1.2 parts by mass based on 1 part by mass of the resin.

Examples of the solvent used for the coating solution for a charge-transporting layer include ketone solvents, ester solvents, ether solvents, and aromatic hydrocarbon solvents. These solvents may be used alone, or two or more thereof may be mixed and used. Among these solvents, use of ether solvents or aromatic hydrocarbon solvents is preferable from the viewpoint of solubility of the resin.

The film thickness of the charge-transporting layer is preferably not less than 5 μm and not more than 50 μm, and more preferably not less than 10 μm and not more than 35 μm.

An antioxidant, an ultraviolet absorbing agent, a plasticizer, and the like can be added to the charge-transporting layer when necessary.

A variety of additives can be added to the respective layers of the electrophotographic photosensitive member according to the present invention. Examples of the additives include deterioration preventing agents such as an antioxidant, an ultraviolet absorbing agent, a light stabilizer, and fine particles such as organic fine particles and inorganic fine particles. Examples of the deterioration preventing agents include hindered phenol antioxidants, hindered amine light stabilizers, sulfur atom-containing antioxidants, and phosphorus atom-containing antioxidants. Examples of the organic fine particles include polymer resin particles such as fluorine atom-containing resin particles, polystyrene fine particles, and polyethylene resin particles. Examples of the inorganic fine particles include metal oxides such as silica and alumina.

In application of the coating solution for each layer, coating methods such as dip coating (immersion coating), spray coating, spin coating, roller coating, Meyer bar coating, and blade coating can be used.

[Electrophotographic Apparatus]

FIG. 1 shows an example of a schematic configuration of an electrophotographic apparatus including a process cartridge having the electrophotographic photosensitive member according to the present invention.

In FIG. 1, a cylindrical electrophotographic photosensitive member 1 is rotated and driven around a shaft 2 in the arrow direction at a predetermined circumferential speed. The surface of the rotated and driven electrophotographic photosensitive member 1 is uniformly charged at a negative predetermined potential by a charging device 3 (such as a primary charging device: a charging roller) in a rotation process. Next, the surface of the electrophotographic photosensitive member 1 receives exposure light 4 (image exposure light) whose intensity is modulated according to a chronological electrical digital image signal of the information of a target image to be output from an exposing device such as slit exposure and laser beam scanning exposure (not shown). Thus, an electrostatic latent image corresponding to the information of the target image is sequentially formed on the surface of the electrophotographic photosensitive member 1.

The electrostatic latent image formed on the surface of the electrophotographic photosensitive member 1 is developed by reversal development using a toner contained in a developer in a developing device 5. Thus, a toner image is formed. Next, the toner image formed and carried on the surface of the electrophotographic photosensitive member 1 is sequentially transferred by the transfer bias from a transferring device 6 (such as a transfer roller) onto a transfer material P (such as paper). The transfer material P is extracted from a transfer material feeding device (not shown) in synchronization with rotation of the electrophotographic photosensitive member 1, and fed between the electrophotographic photosensitive member 1 and the transferring device 6. A bias voltage having a polarity opposite to that the toner has is applied to the transferring device 6 from a bias power supply (not shown).

The transfer material P having the transferred toner image thereon is separated from the surface of the electrophotographic photosensitive member 1, and conveyed to a fixing device 8. There, the toner image is fixed. Then, the transfer material P is conveyed to outside of the apparatus as an image formed product (print, copy).

The surface of the electrophotographic photosensitive member 1 after toner image transfer is cleaned by a cleaning device 7 (such as a cleaning blade) by removing a transfer remaining developer (transfer remaining toner). Next, the surface of the electrophotographic photosensitive member 1 is discharged by the exposure light (not shown) from the exposing device (not shown), and repeatedly used to form an image. As shown in FIG. 1, the exposure is not always necessary if the charging device 3 is a contact charging device using a charging roller.

In the present invention, several components are selected from the electrophotographic photosensitive member 1, the charging device 3, the developing device 5, the transferring device 6 and the cleaning device 7, and the selected components may be accommodated in a container and integrally supported as a process cartridge. Moreover, the process cartridge may be configured to be detachably attached to the main body of the electrophotographic apparatus such as a copier and a laser beam printer. In FIG. 1, the electrophotographic photosensitive member 1, the charging device 3, the developing device 5 and the cleaning device 7 are integrally supported to form a cartridge, and the obtained process cartridge 9 is detachably attached to the main body of the electrophotographic apparatus using a guiding device 10 such as a rail in the main body of the electrophotographic apparatus.

EXAMPLES

Hereinafter, the present invention will be described more in detail using Examples and Comparative Examples. The present invention, however, will not be limited to Examples below. "Parts" in Examples means "parts by mass."

Example 1

An aluminum cylinder having a diameter of 30 mm and a length of 260.5 mm was used as a conductive support. Next, a coating solution for a conductive layer was prepared using 10 parts of $SnO_2$-coated barium sulfate (conductive particle), 2 parts of titanium oxide (pigment for adjusting resistance), 6 parts of a phenol resin, 0.001 parts of silicone oil (leveling agent), and a mixed solvent of 4 parts of methanol and 16 parts of methoxypropanol. The coating solution for a conductive layer was applied onto the aluminum cylinder by dip coating, and thermally cured at 140° C. for 30 minutes to form a conductive layer having a film thickness of 15 μm.

Next, 3 parts of N-methoxymethylated nylon and 3 parts of a copolymerized nylon were dissolved in a mixed solvent of 65 parts of methanol and 30 parts of n-butanol to prepare a coating solution for an intermediate layer.

The coating solution for an intermediate layer was applied onto the conductive layer by dip coating, and dried at 100° C. for 10 minutes to form an intermediate layer having a film thickness of 0.7 μm.

Next, 10 parts of hydroxy gallium phthalocyanine (charge-generating substance) in crystals having strong peaks at Bragg angles (2θ±0.2°) of 7.5°, 9.9°, 16.3°, 18.6°, 25.1°, and 28.3° in CuKα properties X ray diffraction was prepared. To this, 250 parts of cyclohexanone and 5 parts of a polyvinyl butyral resin (trade name: S-LEC BX-1, made by Sekisui Chemical Co., Ltd.) was added. The mixed solution was dispersed under a 23±3° C. atmosphere for 1 hour by a sand mill using glass beads having a diameter of 1 mm. After dispersion, 250 parts of ethyl acetate was added to prepare a coating solution for a charge-generating layer. The coating solution for a charge-generating layer was applied onto the intermediate layer by dip coating, and dried at 100° C. for 10 minutes to form a charge-generating layer having a film thickness of 0.26 μm.

Next, 10 parts of the charge-transporting substance having a structure represented by the above formula (1-1) as the component γ, 4 parts of the polycarbonate resin A(1) synthesized in Synthesis Example 1 as the component α, and 6 parts of the polycarbonate resin C (weight-average molecular weight of 120,000) containing the repeating structure represented by the above formula (C-5) and the repeating structure represented by (C-7) in the ratio of 8:2 as the component β were dissolved in a mixed solvent of 20 parts of tetrahydrofuran and 60 parts of toluene to prepare a coating solution for a charge-transporting layer.

The coating solution for a charge-transporting layer was applied onto the charge-generating layer by dip coating, and dried at 110° C. for 1 hour to form a charge-transporting layer having a film thickness of 16 μm. It was found that the formed charge-transporting layer contains the domain including the component α in the matrix including the components β and γ.

Thus, an electrophotographic photosensitive member having the charge-transporting layer as the surface layer was produced. The components α, β, and γ contained in the charge-transporting layer, the content of the siloxane moiety (siloxane content A) in the polycarbonate resin A, and the content of the siloxane moiety (siloxane content B) in the polycarbonate resin A based on the total mass of all the resins are shown in Table 3.

Next, evaluation will be described.

Evaluation was made about fluctuation of a bright potential (potential fluctuation) when 2,000 sheets were repeatedly output, a relative value of an initial torque, a relative value of the torque when 2,000 sheets were repeatedly output, and observation of the surface of the electrophotographic photosensitive member at the time of measuring the torque.

As an evaluation apparatus, a laser beam printer LBP-2510 made by Canon Inc. was modified such that a charged potential (dark potential) of the electrophotographic photosensitive member might be adjusted, and used. A cleaning blade of a polyurethane rubber was set so as to have a contact angle of 22.5° and a contact pressure of 35 g/cm to the surface of the electrophotographic photosensitive member. Evaluation was made under an environment at a temperature of 23° C. and a relative humidity of 50%.

<Evaluation of Potential Fluctuation>

The exposure amount (image exposure amount) of the laser light source at 780 nm in the evaluation apparatus was set such that the light amount on the surface of the electrophotographic photosensitive member might be 0.3 $\mu J/cm^2$. The potentials of the surface of the electrophotographic photosensitive member (dark potential and bright potential) were measured at the position of the developing device while the developing device was replaced by a jig fixed such that a probe for measuring a potential might be located 130 mm from the end of the electrophotographic photosensitive member. The dark potential of a non-exposed portion of the electrophotographic photosensitive member was set at −450 V, and the bright potential photo-induced discharged from the dark potential by irradiation with laser light was measured. Using a plain paper of an A4 size, 2,000 sheets of an image were continuously output. The fluctuation amounts of the bright potential before and after the output were evaluated. A test chart having a printing ratio of 5% was used. The result is shown in the Potential fluctuation of Table 8.

<Evaluation of Relative Value of Torque>

On the same condition as the evaluation condition of the potential fluctuation, the driving current value (current value A) of a rotating motor for the electrophotographic photosensitive member was measured. In the evaluation, the amount of contact stress between the electrophotographic photosensitive member and the cleaning blade was evaluated. The obtained current value indicates the amount of the contact stress between the electrophotographic photosensitive member and the cleaning blade.

Further, an electrophotographic photosensitive member for comparing the relative value of the torque was produced by the following method. An electrophotographic photosensitive member was produced in the same manner as in Example 1 except that the polycarbonate resin A(1) as the component α used for the charge-transporting layer of the electrophotographic photosensitive member in Example 1 was replaced by the component β in Table 3, and only the component β was used as the resin. The electrophotographic photosensitive member was used as the electrophotographic photosensitive member for comparison.

Using the produced electrophotographic photosensitive member for comparison, the driving current value (current value B) of the rotating motor for the electrophotographic photosensitive member was measured in the same manner as in Example 1.

The ratio of the driving current value (current value A) of the electrophotographic photosensitive member containing the component α according to the present invention to the driving current value (current value B) of the rotating motor for the electrophotographic photosensitive member without the component α was calculated. The obtained numeric value of (current value A)/(current value B) was compared as the relative value of the torque. The numeric value of the relative value of the torque indicates a degree of reduction in the amount of the contact stress between the electrophotographic photosensitive member using the component α and the cleaning blade. As the numeric value of the relative value of the torque is smaller, the degree of reduction in the amount of the contact stress between the electrophotographic photosensitive member and the cleaning blade is higher. The result is shown in the Relative value of initial torque of Table 8.

Subsequently, using a plain paper of an A4 size, 2,000 sheets of an image were continuously output. A test chart having a printing ratio of 5% was used. Then, the relative value of the torque after 2,000 sheets were repeatedly output was measured. The relative value of the torque after 2,000 sheets were repeatedly output was evaluated in the same manner as in the case of the relative value of the initial torque. In this case, 2,000 sheets were repeatedly output also in the electrophotographic photosensitive member for comparison, and the relative value of the torque after 2,000 sheets were repeatedly output was calculated using the driving current value of the rotating motor at that time. The result is shown in the Relative value of torque after 2,000 sheets were repeatedly output in Table 8.

<Evaluation of Matrix-Domain Structure>

In the electrophotographic photosensitive member produced by the method, a vertical cross section of the charge-transporting layer was observed using an ultra-high depth shape measurement microscope VK-9500 (made by Keyence Corporation). At that time, at a magnification of an object lens of 50 times, a field of a 100-μm square (10,000 $\mu m^2$) of the surface of the electrophotographic photosensitive member was observed, the largest diameters of 100 formed domains selected at random in the visual field were measured. From the largest diameters, the average was calculated, and defined as a number average particle size. The results are shown in Table 8.

Examples 2 to 39

An electrophotographic photosensitive member was produced in the same manner as in Example 1 except that the components α, β, and γ of the charge-transporting layer in Example 1 were replaced as shown in Table 3, and evaluated. It was found that in the formed charge-transporting layer, the domain including the component α is contained in the matrix including the components β and γ. The result is shown in Table 8.

The weight-average molecular weight of the polycarbonate resin C used as the component β was as follows:

(C-5)/(C-7)=8/2: 120,000

(C-1): 100,000.

Examples 40 to 78

An electrophotographic photosensitive member was produced in the same manner as in Example 1 except that the components α, β and γ of the charge-transporting layer in Example 1 were replaced as shown in Table 4, and evaluated. It was found that in the formed charge-transporting layer, the domain including the component α is contained in the matrix including the components β and γ. The result is shown in Table 8.

The weight-average molecular weight of the polycarbonate resin C used as the component β was as follows:

(C-5)/(C-7)=8/2: 120,000

(C-2): 130,000

(C-3)/(C-5)=3/7: 100,000.

Examples 79 to 117

An electrophotographic photosensitive member was produced in the same manner as in Example 1 except that the components α, β and γ of the charge-transporting layer in Example 1 were replaced as shown in Table 5, and evaluated. It was found that in the formed charge-transporting layer, the domain including the component α is contained in the matrix including the components β and γ. The result is shown in Table 9.

The weight-average molecular weight of the polycarbonate resin C used as the component β was as follows:

(C-6)/(C-7)=8/2: 120,000

(C-1)/(C-10)=7/3: 130,000

(C-1)/(C-4)=8/2: 120,000

(C-1)/(C-8)=8/2: 100,000

(C-1)/(C-9)=8/2: 90,000.

Examples 118 to 156

An electrophotographic photosensitive member was produced in the same manner as in Example 1 except that the components α, β and γ of the charge-transporting layer in Example 1 were replaced as shown in Table 6, and evaluated. It was found that in the formed charge-transporting layer, the domain including the component α is contained in the matrix including the components β and γ. The result is shown in Table 9. As the charge-transporting substance other than the component γ, a charge-transporting substance having the structure represented by the following formula (2-1) and the structure represented by the following formula (2-2) was mixed with a charge-transporting substance having a structure represented by the above formula (1) or the above formula (1') as the component γ, and used:

(2-1)

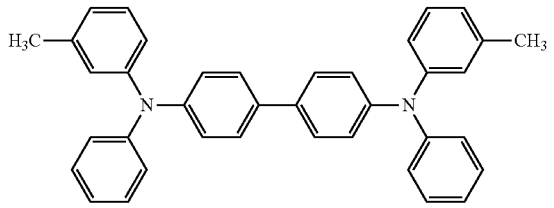

-continued (2-2)

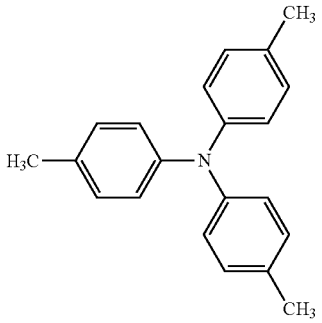

The weight-average molecular weight of the polyester resin D used as the component β was as follows:

(D-1): 120,000

(D-2): 90,000

(D-1)/(D-4)=7/3: 130,000

(D-2)/(D-3)=9/1: 100,000

(D-5): 100,000

(D-7): 110,000.

The repeating structural units represented by the above formulas (D-1), (D-2), (D-3), (D-4), and (D-5) each have the ratio of terephthalic acid/isophthalic acid of 1/1.

Comparative Examples 1 to 12

An electrophotographic photosensitive member was produced in the same manner as in Example 1 except that the polycarbonate resin A(1) in Example 1 was replaced by polycarbonate resin (E(1): weight-average molecular weight of 60,000) containing the repeating structural unit represented by the above formula (A-1) and the repeating structural unit represented by the above formula (B-1) and having the content of the siloxane moiety of 2% by mass in a carbonate resin, and other changes were made as shown in Table 7. The configuration of the resins contained in the charge-transporting layer and the content of the siloxane moiety are shown in Table 7. Evaluation was made in the same manner as in Example 1. The result is shown in Table 10. It was found that the formed charge-transporting layer has no matrix-domain structure.

Comparative Example 13

An electrophotographic photosensitive member was produced in the same manner as in Example 1 except that unlike Example 1, only the polycarbonate resin E(1) was contained as the resin contained in the charge-transporting layer. The configuration of the resins contained in the charge-transporting layer and the content of the siloxane moiety are shown in Table 7. Evaluation was made in the same manner as in Example 1. The result is shown in Table 10. It was found that the formed charge-transporting layer has no matrix-domain structure. As the electrophotographic photosensitive member for comparing the relative value of the torque, the electrophotographic photosensitive member for comparison used in Example 1 was used.

Comparative Examples 14 to 25

An electrophotographic photosensitive member was produced in the same manner as in Example 1 except that the polycarbonate resin A(1) in Example 1 was replaced by the polycarbonate resin (E(2): weight-average molecular weight of 70,000) containing the repeating structural unit represented by the above formula (A-1) and the repeating structural unit represented by the above formula (B-1) and having the content of the siloxane moiety of 50% by mass in the polycarbonate resin, and other changes were made as shown in Table 7. The configuration of the resins contained in the charge-transporting layer and the content of the siloxane moiety are shown in Table 7. Evaluation was made in the same manner as in Example 1. The result is shown in Table 10. In the charge-transporting layer, the matrix-domain structure was formed.

Comparative Example 26

An electrophotographic photosensitive member was produced in the same manner as in Example 1 except that unlike Example 1, only the polycarbonate resin E(2) was contained as the resins contained in the charge-transporting layer. The configuration of the resins contained in the charge-transporting layer and the content of the siloxane moiety are shown in Table 7. Evaluation was made in the same manner as in Example 1. The result is shown in Table 10. It was found that the formed charge-transporting layer has no matrix-domain structure. As the electrophotographic photosensitive member for comparing the relative value of the torque, the electrophotographic photosensitive member for comparison used in Example 1 was used.

Comparative Example 27

The polycarbonate resin A(1) in Example 1 was replaced by the resin E(3) including the repeating structure described in PTL 2. The resin E(3) (weight-average molecular weight of 120,000) is a resin containing the repeating structural unit represented by the following formula (E-3) and the repeating structural unit represented by the above formula (B-5) in a ratio of 10/90. The content of the siloxane moiety in the resin was 7% by mass. A coating solution for a charge-transporting layer was prepared as follows: 9 parts of the charge-transporting substance having the structure represented by the above formula (1-1) as the component γ, 6 parts of the polycarbonate resin E(3), and 1.2 parts of 1,4-bis(dimethylsilyl)benzene were dissolved in a mixed solvent of 20 parts of tetrahydrofuran and 60 parts of toluene; to this, 0.04 parts of a platinum-cyclovinylmethylsiloxane complex (cyclovinylmethylsiloxane solution containing 3 to 3.5% by weight of platinum atoms) was added as a catalyst. The coating solution for a charge-transporting layer was applied onto the charge-generating layer by dip coating, dried at 120° C. for 2 hours, and subsequently dried under the condition of 1 mmHg for 12 hours. Thereby, a charge-transporting layer including the charge-transporting substance and the crosslinked polycarbonate resin and having a film thickness of 16 μm was formed. Other than this, an electrophotographic photosensitive member was produced in the same manner as in Example 1. The configuration of the resins contained in the charge-transporting layer and the content of the siloxane moiety are shown in Table 7. Evaluation was made in the same manner as in Example 1. The result is shown in Table 10. It was found that the formed charge-transporting layer has no matrix-domain structure. The numeric value of the number of repetitions of the siloxane moiety in the repeating structural unit represented by the following formula (E-3) indicates the average of the number of repetitions. In this case, the average of the number of repetitions of the siloxane moiety is 25 and 10 in the repeating structural unit represented by the following formula (E-3) in the resin E(3):

(E-3)

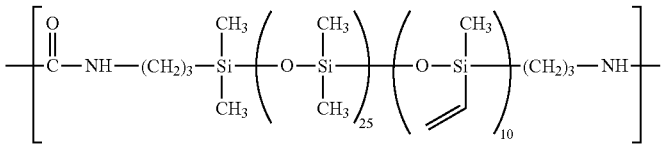

Comparative Example 28

An electrophotographic photosensitive member was produced in the same manner as in Comparative Example 27 except that changes were made in Comparative Example 27 as shown in Table 7. The configuration of the resins contained in the charge-transporting layer and the content of the siloxane moiety are shown in Table 7. Evaluation was made in the same manner as in Example 1. The result is shown in Table 10. It was found that the formed charge-transporting layer has no matrix-domain structure.

Comparative Examples 29 to 34

An electrophotographic photosensitive member was produced in the same manner as in Example 1 except that the polycarbonate resin A(1) in Example 1 was replaced by the resin E(4) (weight-average molecular weight of 60,000) containing the repeating structural unit having the structure described in PTL 1, i.e., represented by the following formula (E-4) and the repeating structural unit represented by the above formula (D-1), and having the content of the siloxane moiety of 30% by mass in the resin, and other changes were made as shown in Table 7. The repeating structural unit represented by the following formula (E-4) and that represented by the above formula (D-1) have a ratio of terephthalic acid/isophthalic acid skeleton of 1/1. The configuration of the resins contained in the charge-transporting layer and the content of the siloxane moiety are shown in Table 7. Evaluation was made in the same manner as in Example 1. The result is shown in Table 10. In the formed charge-transporting layer, the matrix-domain structure was formed. As the electrophotographic photosensitive member for comparing the relative value of the torque, the electrophotographic photosensitive member for comparison used in Example 121 was used. The numeric value of the number of repetitions of the siloxane moiety in the repeating structural unit represented by the following formula (E-4) indicates the average of the number of repetitions. In this case, the average of the number of repetitions of the siloxane moiety is 40 in the repeating structural unit represented by the following formula (E-4) in the resin E(4):

Comparative Examples 35 to 38

An electrophotographic photosensitive member was produced in the same manner as in Example 1 except that the polycarbonate resin A(1) in Example 1 was replaced by the resin E(4), the charge-transporting substance was replaced by that having the structure represented by the above formula (2-1), and other changes were made as shown in Table 7. The configuration of the resins contained in the charge-transporting layer and the content of the siloxane moiety are shown in Table 7. Evaluation was made in the same manner as in Example 1. The result is shown in Table 10. In the formed charge-transporting layer, the matrix-domain structure was formed. As the electrophotographic photosensitive member for comparing the relative value of the torque, the electrophotographic photosensitive member for comparison used in Example 121 was used.

Comparative Examples 39 and 40

An electrophotographic photosensitive member was produced in the same manner as in Example 1 except that the polycarbonate resin A(1) in Example 1 was replaced by the polycarbonate resin A(2), the charge-transporting substance was replaced by that having the structure represented by the above formula (2-1), and other changes were made as shown in Table 7. The configuration of the resins contained in the charge-transporting layer and the content of the siloxane moiety are shown in Table 7. Evaluation was made in the same manner as in Example 1. The result is shown in Table 10. In the formed charge-transporting layer, the matrix-domain structure was formed. As the electrophotographic photosensitive member for comparing the relative value of the torque, the electrophotographic photosensitive member for comparison used in Example 121 was used.

Comparative Examples 41 to 46

An electrophotographic photosensitive member was produced in the same manner as in Example 1 except that the polycarbonate resin A(1) in Example 1 was replaced by the resin E(3), and other changes were made as shown in Table 7. Evaluation was made in the same manner as in Example 1.

(E-4)

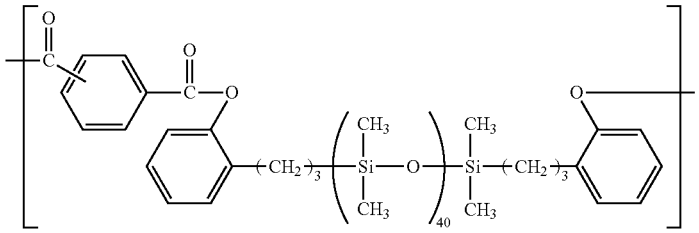

The result is shown in Table 10. In the formed charge-transporting layer, the matrix-domain structure was formed.

Comparative Example 47

An electrophotographic photosensitive member was produced in the same manner as in Example 1 except that only the polycarbonate resin E(3) was contained as the resins contained in the charge-transporting layer. The configuration of the resins contained in the charge-transporting layer and the content of the siloxane moiety are shown in Table 7. Evaluation was made in the same manner as in Example 1. The result is shown in Table 10. It was found that the formed charge-transporting layer has no matrix-domain structure.

TABLE 3

| | Component [γ] | Component [α] | Siloxane content A (% by mass) | Component [β] | Mixing ratio of component [α] to component [β] | Siloxane content B (% by mass) |
|---|---|---|---|---|---|---|
| Example 1 | (1-1) | Resin A (1) | 40 | (C-5)/(C-7) = 8/2 | 4/6 | 16 |
| Example 2 | (1-1) | Resin A (1) | 40 | (C-5)/(C-7) = 8/2 | 3/7 | 12 |
| Example 3 | (1-1) | Resin A (1) | 40 | (C-5)/(C-7) = 8/2 | 2/8 | 8 |
| Example 4 | (1-1) | Resin A (2) | 30 | (C-1) | 3/7 | 9 |
| Example 5 | (1-1) | Resin A (2) | 30 | (C-1) | 2/8 | 6 |
| Example 6 | (1-1) | Resin A (3) | 20 | (C-1) | 3/7 | 6 |
| Example 7 | (1-1) | Resin A (3) | 20 | (C-1) | 2/8 | 4 |
| Example 8 | (1-1) | Resin A (4) | 10 | (C-5)/(C-7) = 8/2 | 3/7 | 3 |
| Example 9 | (1-1) | Resin A (4) | 10 | (C-5)/(C-7) = 8/2 | 2/8 | 2 |
| Example 10 | (1-1)/(1-2) = 7/3 | Resin A (5) | 20 | (C-5)/(C-7) = 8/2 | 3/7 | 6 |
| Example 11 | (1-1)/(1-2) = 7/3 | Resin A (6) | 20 | (C-5)/(C-7) = 8/2 | 3/7 | 6 |
| Example 12 | (1-1)/(1-2) = 7/3 | Resin A (7) | 20 | (C-5)/(C-7) = 8/2 | 3/7 | 6 |
| Example 13 | (1-1)/(1-2) = 7/3 | Resin A (8) | 20 | (C-5)/(C-7) = 8/2 | 3/7 | 6 |
| Example 14 | (1-1) | Resin A (9) | 30 | (C-5)/(C-7) = 8/2 | 4/6 | 12 |
| Example 15 | (1-1) | Resin A (9) | 30 | (C-5)/(C-7) = 8/2 | 2/8 | 6 |
| Example 16 | (1-1) | Resin A (10) | 20 | (C-5)/(C-7) = 8/2 | 3/7 | 6 |
| Example 17 | (1-1) | Resin A (10) | 20 | (C-5)/(C-7) = 8/2 | 2/8 | 4 |
| Example 18 | (1-1) | Resin A (11) | 20 | (C-1) | 4/6 | 8 |
| Example 19 | (1-1) | Resin A (11) | 20 | (C-1) | 3/7 | 6 |
| Example 20 | (1-1) | Resin A (12) | 5 | (C-1) | 2/8 | 1 |
| Example 21 | (1-1) | Resin A (13) | 30 | (C-1) | 3/7 | 9 |
| Example 22 | (1-1) | Resin A (13) | 30 | (C-1) | 2/8 | 6 |
| Example 23 | (1-1) | Resin A (14) | 10 | (C-1) | 3/7 | 3 |
| Example 24 | (1-1) | Resin A (14) | 10 | (C-1) | 2/8 | 2 |
| Example 25 | (1-1) | Resin A (15) | 5 | (C-5)/(C-7) = 8/2 | 2/8 | 1 |
| Example 26 | (1-1) | Resin A (16) | 20 | (C-5)/(C-7) = 8/2 | 3/7 | 6 |
| Example 27 | (1-1) | Resin A (16) | 20 | (C-5)/(C-7) = 8/2 | 2/8 | 4 |
| Example 28 | (1-1) | Resin A (17) | 40 | (C-5)/(C-7) = 8/2 | 5/5 | 20 |
| Example 29 | (1-1) | Resin A (17) | 40 | (C-5)/(C-7) = 8/2 | 2/8 | 8 |
| Example 30 | (1-1) | Resin A (18) | 20 | (C-5)/(C-7) = 8/2 | 3/7 | 6 |
| Example 31 | (1-1) | Resin A (18) | 20 | (C-5)/(C-7) = 8/2 | 2/8 | 4 |
| Example 32 | (1-1)/(1-2) = 7/3 | Resin A (19) | 20 | (C-5)/(C-7) = 8/2 | 3/7 | 6 |
| Example 33 | (1-1)/(1-2) = 7/3 | Resin A (19) | 20 | (C-5)/(C-7) = 8/2 | 2/8 | 4 |
| Example 34 | (1-1)/(1-2) = 7/3 | Resin A (20) | 40 | (C-5)/(C-7) = 8/2 | 5/5 | 20 |
| Example 35 | (1-1)/(1-2) = 7/3 | Resin A (20) | 40 | (C-5)/(C-7) = 8/2 | 2/8 | 8 |
| Example 36 | (1-1)/(1-2) = 7/3 | Resin A (21) | 30 | (C-1) | 4/6 | 12 |
| Example 37 | (1-1) | Resin A (22) | 5 | (C-1) | 4/6 | 2 |
| Example 38 | (1-1) | Resin A (23) | 20 | (C-1) | 4/6 | 8 |
| Example 39 | (1-1) | Resin A (24) | 10 | (C-1) | 4/6 | 4 |

TABLE 4

| | Component [γ] | Component [α] | Siloxane content A (% by mass) | Component [β] | Mixing ratio of component [α] to component [β] | Siloxane content B (% by mass) |
|---|---|---|---|---|---|---|
| Example 40 | (1-1)/(1-6) = 8/2 | Resin A (1) | 40 | (C-3)/(C-5) = 3/7 | 4/6 | 16 |
| Example 41 | (1-1)/(1-6) = 8/2 | Resin A (1) | 40 | (C-3)/(C-5) = 3/7 | 3/7 | 12 |
| Example 42 | (1-1)/(1-6) = 8/2 | Resin A (1) | 40 | (C-3)/(C-5) = 3/7 | 2/8 | 8 |
| Example 43 | (1-1)/(1-6) = 8/2 | Resin A (2) | 30 | (C-2) | 3/7 | 9 |
| Example 44 | (1-1)/(1-6) = 8/2 | Resin A (2) | 30 | (C-2) | 2/8 | 6 |
| Example 45 | (1-1)/(1-6) = 8/2 | Resin A (3) | 20 | (C-2) | 3/7 | 6 |
| Example 46 | (1-1)/(1-6) = 8/2 | Resin A (3) | 20 | (C-2) | 2/8 | 4 |
| Example 47 | (1-1)/(1-6) = 8/2 | Resin A (4) | 10 | (C-5)/(C-7) = 8/2 | 3/7 | 3 |
| Example 48 | (1-1)/(1-6) = 8/2 | Resin A (4) | 10 | (C-5)/(C-7) = 8/2 | 2/8 | 2 |
| Example 49 | (1-1)/(1-8) = 7/3 | Resin A (5) | 20 | (C-5)/(C-7) = 8/2 | 3/7 | 6 |

TABLE 4-continued

| | Component [γ] | Component [α] | Siloxane content A (% by mass) | Component [β] | Mixing ratio of component [α] to component [β] | Siloxane content B (% by mass) |
|---|---|---|---|---|---|---|
| Example 50 | (1-1)/(1-8) = 7/3 | Resin A (6) | 20 | (C-5)/(C-7) = 8/2 | 3/7 | 6 |
| Example 51 | (1-1)/(1-8) = 7/3 | Resin A (7) | 20 | (C-5)/(C-7) = 8/2 | 3/7 | 6 |
| Example 52 | (1-1)/(1-8) = 7/3 | Resin A (8) | 20 | (C-5)/(C-7) = 8/2 | 3/7 | 6 |
| Example 53 | (1-6)/(1-7) = 5/5 | Resin A (9) | 30 | (C-5)/(C-7) = 8/2 | 4/6 | 12 |
| Example 54 | (1-6)/(1-7) = 5/5 | Resin A (9) | 30 | (C-5)/(C-7) = 8/2 | 2/8 | 6 |
| Example 55 | (1-6)/(1-7) = 5/5 | Resin A (10) | 20 | (C-5)/(C-7) = 8/2 | 3/7 | 6 |
| Example 56 | (1-6)/(1-7) = 5/5 | Resin A (10) | 20 | (C-5)/(C-7) = 8/2 | 2/8 | 4 |
| Example 57 | (1-8) | Resin A (11) | 20 | (C-3)/(C-5) = 3/7 | 4/6 | 8 |
| Example 58 | (1-8) | Resin A (11) | 20 | (C-3)/(C-5) = 3/7 | 3/7 | 6 |
| Example 59 | (1-8) | Resin A (12) | 5 | (C-3)/(C-5) = 3/7 | 2/8 | 1 |
| Example 60 | (1-8) | Resin A (13) | 30 | (C-3)/(C-5) = 3/7 | 3/7 | 9 |
| Example 61 | (1-8) | Resin A (13) | 30 | (C-3)/(C-5) = 3/7 | 2/8 | 6 |
| Example 62 | (1-8) | Resin A (14) | 10 | (C-3)/(C-5) = 3/7 | 3/7 | 3 |
| Example 63 | (1-8) | Resin A (14) | 10 | (C-3)/(C-5) = 3/7 | 2/8 | 2 |
| Example 64 | (1-6)/(1-7) = 5/5 | Resin A (15) | 5 | (C-5)/(C-7) = 8/2 | 2/8 | 1 |
| Example 65 | (1-6)/(1-7) = 5/5 | Resin A (16) | 20 | (C-5)/(C-7) = 8/2 | 3/7 | 6 |
| Example 66 | (1-6)/(1-7) = 5/5 | Resin A (16) | 20 | (C-5)/(C-7) = 8/2 | 2/8 | 4 |
| Example 67 | (1-6)/(1-7) = 5/5 | Resin A (17) | 40 | (C-5)/(C-7) = 8/2 | 5/5 | 20 |
| Example 68 | (1-6)/(1-7) = 5/5 | Resin A (17) | 40 | (C-5)/(C-7) = 8/2 | 2/8 | 8 |
| Example 69 | (1-1)/(1-8) = 7/3 | Resin A (18) | 20 | (C-5)/(C-7) = 8/2 | 3/7 | 6 |
| Example 70 | (1-1)/(1-8) = 7/3 | Resin A (18) | 20 | (C-5)/(C-7) = 8/2 | 2/8 | 4 |
| Example 71 | (1-1)/(1-8) = 7/3 | Resin A (19) | 20 | (C-5)/(C-7) = 8/2 | 3/7 | 6 |
| Example 72 | (1-1)/(1-8) = 7/3 | Resin A (19) | 20 | (C-5)/(C-7) = 8/2 | 2/8 | 4 |
| Example 73 | (1-1)/(1-8) = 7/3 | Resin A (20) | 40 | (C-5)/(C-7) = 8/2 | 5/5 | 20 |
| Example 74 | (1-1)/(1-8) = 7/3 | Resin A (20) | 40 | (C-5)/(C-7) = 8/2 | 2/8 | 8 |
| Example 75 | (1-1)/(1-8) = 7/3 | Resin A (21) | 30 | (C-2) | 4/6 | 12 |
| Example 76 | (1-1)/(1-8) = 7/3 | Resin A (22) | 5 | (C-2) | 4/6 | 2 |
| Example 77 | (1-1)/(1-8) = 7/3 | Resin A (23) | 20 | (C-2) | 4/6 | 8 |
| Example 78 | (1-1)/(1-8) = 7/3 | Resin A (24) | 10 | (C-2) | 4/6 | 4 |

TABLE 5

| | Component [γ] | Component [α] | Siloxane content A (% by mass) | Component [β] | Mixing ratio of component [α] to component [β] | Siloxane content B (% by mass) |
|---|---|---|---|---|---|---|
| Example 79 | (1-3) | Resin A (1) | 40 | (C-6)/(C-7) = 8/2 | 4/6 | 16 |
| Example 80 | (1-3) | Resin A (1) | 40 | (C-6)/(C-7) = 8/2 | 3/7 | 12 |
| Example 81 | (1-3) | Resin A (1) | 40 | (C-6)/(C-7) = 8/2 | 2/8 | 8 |
| Example 82 | (1-4) | Resin A (2) | 30 | (C-6)/(C-7) = 8/2 | 3/7 | 9 |
| Example 83 | (1-4) | Resin A (2) | 30 | (C-6)/(C-7) = 8/2 | 2/8 | 6 |
| Example 84 | (1-5) | Resin A (3) | 20 | (C-6)/(C-7) = 8/2 | 3/7 | 6 |
| Example 85 | (1-5) | Resin A (3) | 20 | (C-6)/(C-7) = 8/2 | 2/8 | 4 |
| Example 86 | (1-3) | Resin A (4) | 10 | (C-1)/(C-10) = 7/3 | 3/7 | 3 |
| Example 87 | (1-3) | Resin A (4) | 10 | (C-1)/(C-10) = 7/3 | 2/8 | 2 |
| Example 88 | (1-3) | Resin A (5) | 20 | (C-1)/(C-4) = 8/2 | 3/7 | 6 |
| Example 89 | (1-3) | Resin A (6) | 20 | (C-1)/(C-4) = 8/2 | 3/7 | 6 |
| Example 90 | (1-3) | Resin A (7) | 20 | (C-1)/(C-4) = 8/2 | 3/7 | 6 |
| Example 91 | (1-3) | Resin A (8) | 20 | (C-1)/(C-4) = 8/2 | 3/7 | 6 |
| Example 92 | (1-5) | Resin A (9) | 30 | (C-1)/(C-10) = 7/3 | 4/6 | 12 |
| Example 93 | (1-5) | Resin A (9) | 30 | (C-1)/(C-10) = 7/3 | 2/8 | 6 |
| Example 94 | (1-5) | Resin A (10) | 20 | (C-1)/(C-10) = 7/3 | 3/7 | 6 |
| Example 95 | (1-5) | Resin A (10) | 20 | (C-1)/(C-10) = 7/3 | 2/8 | 4 |
| Example 96 | (1-4) | Resin A (11) | 20 | (C-1)/(C-4) = 8/2 | 4/6 | 8 |
| Example 97 | (1-4) | Resin A (11) | 20 | (C-1)/(C-4) = 8/2 | 3/7 | 6 |
| Example 98 | (1-4) | Resin A (12) | 5 | (C-1)/(C-4) = 8/2 | 2/8 | 1 |
| Example 99 | (1-4) | Resin A (13) | 30 | (C-1)/(C-4) = 8/2 | 3/7 | 9 |
| Example 100 | (1-4) | Resin A (13) | 30 | (C-1)/(C-4) = 8/2 | 2/8 | 6 |
| Example 101 | (1-5) | Resin A (14) | 10 | (C-1)/(C-8) = 8/2 | 3/7 | 3 |
| Example 102 | (1-5) | Resin A (14) | 10 | (C-1)/(C-8) = 8/2 | 2/8 | 2 |
| Example 103 | (1-5) | Resin A (15) | 5 | (C-1)/(C-8) = 8/2 | 2/8 | 1 |
| Example 104 | (1-5) | Resin A (16) | 20 | (C-1)/(C-8) = 8/2 | 3/7 | 6 |
| Example 105 | (1-5) | Resin A (16) | 20 | (C-1)/(C-8) = 8/2 | 2/8 | 4 |
| Example 106 | (1-5) | Resin A (17) | 40 | (C-1)/(C-8) = 8/2 | 5/5 | 20 |
| Example 107 | (1-5) | Resin A (17) | 40 | (C-1)/(C-8) = 8/2 | 2/8 | 8 |
| Example 108 | (1-5) | Resin A (18) | 20 | (C-1)/(C-8) = 8/2 | 3/7 | 6 |

TABLE 5-continued

| | Component [γ] | Component [α] | Siloxane content A (% by mass) | Component [β] | Mixing ratio of component [α] to component [β] | Siloxane content B (% by mass) |
|---|---|---|---|---|---|---|
| Example 109 | (1-5) | Resin A (18) | 20 | (C-1)/(C-8) = 8/2 | 2/8 | 4 |
| Example 110 | (1-5) | Resin A (19) | 20 | (C-1)/(C-9) = 8/2 | 3/7 | 6 |
| Example 111 | (1-5) | Resin A (19) | 20 | (C-1)/(C-9) = 8/2 | 2/8 | 4 |
| Example 112 | (1-5) | Resin A (20) | 40 | (C-1)/(C-9) = 8/2 | 5/5 | 20 |
| Example 113 | (1-5) | Resin A (20) | 40 | (C-1)/(C-9) = 8/2 | 2/8 | 8 |
| Example 114 | (1-4) | Resin A (21) | 30 | (C-6)/(C-7) = 8/2 | 4/6 | 12 |
| Example 115 | (1-4) | Resin A (22) | 5 | (C-6)/(C-7) = 8/2 | 4/6 | 2 |
| Example 116 | (1-4) | Resin A (23) | 20 | (C-6)/(C-7) = 8/2 | 4/6 | 8 |
| Example 117 | (1-4) | Resin A (24) | 10 | (C-6)/(C-7) = 8/2 | 4/6 | 4 |

TABLE 6

| | Component [γ]/another charge-transporting substance | Component [α] | Siloxane content A (% by mass) | Component [β] | Mixing ratio of component [α] to component [β] | Siloxane content B (% by mass) |
|---|---|---|---|---|---|---|
| Example 118 | (1-1)/(2-1) = 8/2 | Resin A (1) | 40 | (D-2) | 4/6 | 16 |
| Example 119 | (1-1)/(2-1) = 8/2 | Resin A (1) | 40 | (D-2) | 3/7 | 12 |
| Example 120 | (1-1)/(2-1) = 8/2 | Resin A (1) | 40 | (D-2) | 2/8 | 8 |
| Example 121 | (1-1)/(2-1) = 8/2 | Resin A (2) | 30 | (D-1) | 3/7 | 9 |
| Example 122 | (1-1)/(2-1) = 8/2 | Resin A (2) | 30 | (D-1) | 2/8 | 6 |
| Example 123 | (1-1)/(2-1) = 8/2 | Resin A (3) | 20 | (D-1) | 3/7 | 6 |
| Example 124 | (1-1)/(2-1) = 8/2 | Resin A (3) | 20 | (D-1) | 2/8 | 4 |
| Example 125 | (1-1)/(2-1) = 8/2 | Resin A (4) | 10 | (D-1)/(D-4) = 7/3 | 3/7 | 3 |
| Example 126 | (1-1)/(2-1) = 8/2 | Resin A (4) | 10 | (D-1)/(D-4) = 7/3 | 2/8 | 2 |
| Example 127 | (1-1)/(2-1) = 8/2 | Resin A (5) | 20 | (D-1)/(D-4) = 7/3 | 3/7 | 6 |
| Example 128 | (1-1)/(2-1) = 8/2 | Resin A (6) | 20 | (D-1)/(D-4) = 7/3 | 3/7 | 6 |
| Example 129 | (1-1)/(2-1) = 8/2 | Resin A (7) | 20 | (D-1)/(D-4) = 7/3 | 3/7 | 6 |
| Example 130 | (1-1)/(2-1) = 8/2 | Resin A (8) | 20 | (D-1)/(D-4) = 7/3 | 3/7 | 6 |
| Example 131 | (1-1)/(2-1) = 8/2 | Resin A (9) | 30 | (D-2)/(D-3) = 9/1 | 4/6 | 12 |
| Example 132 | (1-1)/(2-1) = 8/2 | Resin A (9) | 30 | (D-2)/(D-3) = 9/1 | 2/8 | 6 |
| Example 133 | (1-1)/(2-1) = 8/2 | Resin A (10) | 20 | (D-2)/(D-3) = 9/1 | 3/7 | 6 |
| Example 134 | (1-1)/(2-1) = 8/2 | Resin A (10) | 20 | (D-2)/(D-3) = 9/1 | 2/8 | 4 |
| Example 135 | (1-1)/(2-1) = 8/2 | Resin A (11) | 20 | (D-2) | 4/6 | 8 |
| Example 136 | (1-1)/(2-1) = 8/2 | Resin A (11) | 20 | (D-2) | 3/7 | 6 |
| Example 137 | (1-1)/(2-1) = 8/2 | Resin A (12) | 5 | (D-2) | 2/8 | 1 |
| Example 138 | (1-1)/(2-2) = 8/2 | Resin A (13) | 30 | (D-2) | 3/7 | 9 |
| Example 139 | (1-1)/(2-2) = 8/2 | Resin A (13) | 30 | (D-2) | 2/8 | 6 |
| Example 140 | (1-1)/(2-2) = 8/2 | Resin A (14) | 10 | (D-7) | 3/7 | 3 |
| Example 141 | (1-1)/(2-2) = 8/2 | Resin A (14) | 10 | (D-7) | 2/8 | 2 |
| Example 142 | (1-1)/(2-2) = 8/2 | Resin A (15) | 5 | (D-7) | 2/8 | 1 |
| Example 143 | (1-1)/(2-2) = 8/2 | Resin A (16) | 20 | (D-7) | 3/7 | 6 |
| Example 144 | (1-1)/(2-2) = 8/2 | Resin A (16) | 20 | (D-7) | 2/8 | 4 |
| Example 145 | (1-1)/(2-1) = 8/2 | Resin A (17) | 40 | (D-7) | 5/5 | 20 |
| Example 146 | (1-1)/(2-1) = 8/2 | Resin A (17) | 40 | (D-7) | 2/8 | 8 |
| Example 147 | (1-1)/(2-1) = 8/2 | Resin A (18) | 20 | (D-5) | 3/7 | 6 |
| Example 148 | (1-1)/(2-1) = 8/2 | Resin A (18) | 20 | (D-5) | 2/8 | 4 |
| Example 149 | (1-1)/(2-1) = 8/2 | Resin A (19) | 20 | (D-5) | 3/7 | 6 |
| Example 150 | (1-1)/(2-1) = 8/2 | Resin A (19) | 20 | (D-5) | 2/8 | 4 |
| Example 151 | (1-1)/(2-1) = 8/2 | Resin A (20) | 40 | (D-7) | 5/5 | 20 |
| Example 152 | (1-1)/(2-1) = 8/2 | Resin A (20) | 40 | (D-7) | 2/8 | 8 |
| Example 153 | (1-1)/(2-2) = 8/2 | Resin A (21) | 30 | (D-7) | 4/6 | 12 |
| Example 154 | (1-1)/(2-2) = 8/2 | Resin A (22) | 5 | (D-7) | 4/6 | 2 |
| Example 155 | (1-1)/(2-2) = 8/2 | Resin A (23) | 20 | (D-7) | 4/6 | 8 |
| Example 156 | (1-1)/(2-2) = 8/2 | Resin A (24) | 10 | (D-7) | 4/6 | 4 |

The "Component [γ]" in Tables 3 to 6 means the component γ contained in the charge-transporting layer. In the case where the charge-transporting substances are mixed and used, it means the kinds of the component γ and another charge-transporting substance and the mixing ratio thereof. The "Component [α]" in Tables 3 to 6 means the configuration of the component α. The "Siloxane content A (% by mass)" in Tables 3 to 6 means the content of the siloxane moiety (% by mass) in the polycarbonate resin A. The "Component [β]", in Tables 3 to 6 means the configuration of the component β, and any resin thereof has no siloxane moiety. The "Mixing ratio of component [α] to component [β]", in Tables 3 to 6 means the mixing ratio of the component α to the component β (component α/component β) in the charge-transporting layer. The "Siloxane content B (% by mass)" in Tables 3 to 6 means the content of siloxane moiety (% by mass) in the polycarbonate resin A based on the total mass of the resins in the charge-transporting layer.

siloxane moiety (% by mass) in the "Resin E" based on the total mass of all the resins in the charge-transporting layer.

Hereinafter, evaluation results of Examples 1 to 156 and Comparative Examples 1 to 47 are shown in Tables 8 to 10.

TABLE 7

| | Charge-transporting substance | | | | Siloxane | | Mixing ratio | Siloxane |
|---|---|---|---|---|---|---|---|---|
| | Component [γ] | Another charge-transporting substance | Proportion | Resin | content A (% by mass) | Component [β] | of resin to component [β] | content B (% by mass) |
| Comp. Ex. 1 | (1-1) | — | | Resin E (1) | 2 | (C-5)/(C-7) = 8/2 | 3/7 | 0.6 |
| Comp. Ex. 2 | (1-1)/(1-2) | — | 7/3 | Resin E (1) | 2 | (C-5)/(C-7) = 8/2 | 3/7 | 0.6 |
| Comp. Ex. 3 | (1-6)/(1-7) | — | 5/5 | Resin E (1) | 2 | (C-5)/(C-7) = 8/2 | 3/7 | 0.6 |
| Comp. Ex. 4 | (1-3) | — | — | Resin E (1) | 2 | (C-1)/(C-4) = 8/2 | 3/7 | 0.6 |
| Comp. Ex. 5 | (1-5) | — | — | Resin E (1) | 2 | (C-1)/(C-10) = 7/3 | 3/7 | 0.6 |
| Comp. Ex. 6 | (1-1) | (2-1) | 8/2 | Resin E (1) | 2 | (D-2) | 3/7 | 0.6 |
| Comp. Ex. 7 | (1-1) | — | — | Resin E (1) | 2 | (C-5)/(C-7) = 8/2 | 5/5 | 1 |
| Comp. Ex. 8 | (1-1)/(1-2) | — | 7/3 | Resin E (1) | 2 | (C-5)/(C-7) = 8/2 | 5/5 | 1 |
| Comp. Ex. 9 | (1-6)/(1-7) | — | 5/5 | Resin E (1) | 2 | (C-5)/(C-7) = 8/2 | 5/5 | 1 |
| Comp. Ex. 10 | (1-3) | — | — | Resin E (1) | 2 | (C-1)/(C-4) = 8/2 | 5/5 | 1 |
| Comp. Ex. 11 | (1-5) | — | — | Resin E (1) | 2 | (C-1)/(C-10) = 7/3 | 5/5 | 1 |
| Comp. Ex. 12 | (1-1) | (2-1) | 8/2 | Resin E (1) | 2 | (D-2) | 5/5 | 1 |
| Comp. Ex. 13 | (1-1) | — | — | Resin E (1) | 2 | — | — | 2 |
| Comp. Ex. 14 | (1-1) | — | — | Resin E (2) | 50 | (C-5)/(C-7) = 8/2 | 3/7 | 15 |
| Comp. Ex. 15 | (1-1)/(1-2) | — | 7/3 | Resin E (2) | 50 | (C-5)/(C-7) = 8/2 | 3/7 | 15 |
| Comp. Ex. 16 | (1-6)/(1-7) | — | 5/5 | Resin E (2) | 50 | (C-5)/(C-7) = 8/2 | 3/7 | 15 |
| Comp. Ex. 17 | (1-3) | — | — | Resin E (2) | 50 | (C-1)/(C-4) = 8/2 | 3/7 | 15 |
| Comp. Ex. 18 | (1-5) | — | — | Resin E (2) | 50 | (C-1)/(C-10) = 7/3 | 3/7 | 15 |
| Comp. Ex. 19 | (1-1) | (2-1) | 8/2 | Resin E (2) | 50 | (D-2) | 3/7 | 15 |
| Comp. Ex. 20 | (1-1) | — | — | Resin E (2) | 50 | (C-5)/(C-7) = 8/2 | 1/9 | 5 |
| Comp. Ex. 21 | (1-1)/(1-2) | — | 7/3 | Resin E (2) | 50 | (C-5)/(C-7) = 8/2 | 1/9 | 5 |
| Comp. Ex. 22 | (1-6)/(1-7) | — | 5/5 | Resin E (2) | 50 | (C-5)/(C-7) = 8/2 | 1/9 | 5 |
| Comp. Ex. 23 | (1-3) | — | — | Resin E (2) | 50 | (C-1)/(C-4) = 8/2 | 1/9 | 5 |
| Comp. Ex. 24 | (1-5) | — | — | Resin E (2) | 50 | (C-1)/(C-10) = 7/3 | 1/9 | 5 |
| Comp. Ex. 25 | (1-1) | (2-1) | 8/2 | Resin E (2) | 50 | (D-2) | 1/9 | 5 |
| Comp. Ex. 26 | (1-1) | — | — | Resin E (2) | 50 | — | — | 50 |
| Comp. Ex. 27 | (1-1) | — | — | Resin E (3) | 7 | — | — | 7 |
| Comp. Ex. 28 | (1-6)/(1-7) | — | 5/5 | Resin E (3) | 7 | — | — | 7 |
| Comp. Ex. 29 | (1-1) | — | — | Resin E (4) | 30 | (C-5)/(C-7) = 8/2 | 3/7 | 9 |
| Comp. Ex. 30 | (1-1)/(1-2) | — | 7/3 | Resin E (4) | 30 | (C-5)/(C-7) = 8/2 | 3/7 | 9 |
| Comp. Ex. 31 | (1-6)/(1-7) | — | 5/5 | Resin E (4) | 30 | (C-5)/(C-7) = 8/2 | 3/7 | 9 |
| Comp. Ex. 32 | (1-3) | — | — | Resin E (4) | 30 | (C-1)/(C-4) = 8/2 | 3/7 | 9 |
| Comp. Ex. 33 | (1-5) | — | — | Resin E (4) | 30 | (C-1)/(C-10) = 7/3 | 3/7 | 9 |
| Comp. Ex. 34 | (1-1)/(2-1) | — | 8/2 | Resin E (4) | 30 | (D-2) | 3/7 | 9 |
| Comp. Ex. 35 | — | (2-1) | — | Resin E (4) | 30 | (C-5)/(C-7) = 8/2 | 3/7 | 9 |
| Comp. Ex. 36 | — | (2-1) | — | Resin E (4) | 30 | (C-1)/(C-4) = 8/2 | 3/7 | 9 |
| Comp. Ex. 37 | — | (2-1) | — | Resin E (4) | 30 | (C-1)/(C-10) = 7/3 | 3/7 | 9 |
| Comp. Ex. 38 | — | (2-1) | — | Resin E (4) | 30 | (D-2) | 3/7 | 9 |
| Comp. Ex. 39 | — | (2-1) | — | Resin A (2) | 30 | (C-5)/(C-7) = 8/2 | 3/7 | 9 |
| Comp. Ex. 40 | — | (2-1) | — | Resin A (2) | 30 | (D-2) | 3/7 | 9 |
| Comp. Ex. 41 | (1-1) | — | — | Resin E (3) | 7 | (C-5)/(C-7) = 8/2 | 3/7 | 2 |
| Comp. Ex. 42 | (1-1)/(1-2) | — | 7/3 | Resin E (3) | 7 | (C-5)/(C-7) = 8/2 | 3/7 | 2 |
| Comp. Ex. 43 | (1-6)/(1-7) | — | 5/5 | Resin E (3) | 7 | (C-5)/(C-7) = 8/2 | 3/7 | 2 |
| Comp. Ex. 44 | (1-3) | — | — | Resin E (3) | 7 | (C-1)/(C-4) = 8/2 | 3/7 | 2 |
| Comp. Ex. 45 | (1-5) | — | — | Resin E (3) | 7 | (C-1)/(C-10) = 7/3 | 3/7 | 2 |
| Comp. Ex. 46 | (1-1) | (2-1) | 8/2 | Resin E (3) | 7 | (D-2) | 3/7 | 2 |
| Comp. Ex. 47 | (1-1) | — | — | Resin E (3) | 7 | — | — | 7 |

The "Charge-transporting substance" in Table 7 means the charge-transporting substance contained in the charge-transporting layer. The proportion represents the mixing ratio of two components γ or the mixing ratio of component γ/another charge-transporting substance. The "Resin" in Table 7 means the resin E or the polycarbonate resin A having a siloxane moiety. The "Siloxane content A (% by mass)" in Table 7 means the content of the siloxane moiety (% by mass) in the "Resin". The "Component [β]", in Table 7 means the configuration of the component β. The "Mixing ratio of resin to component [β]" in Table 7 means the mixing ratio of the resin E or polycarbonate resin A to the component β (resin/component β) in the charge-transporting layer. The "Siloxane content B (% by mass)" in Table 7 means the content of the

TABLE 8

| | Potential fluctuation (V) | Relative value of initial torque | Relative value of torque after 2,000 sheets are repeatedly output | Particle size (nm) |
|---|---|---|---|---|
| Ex. 1 | 10 | 0.68 | 0.74 | 420 |
| Ex. 2 | 8 | 0.70 | 0.75 | 330 |
| Ex. 3 | 5 | 0.72 | 0.77 | 260 |
| Ex. 4 | 8 | 0.65 | 0.70 | 400 |
| Ex. 5 | 5 | 0.68 | 0.73 | 300 |
| Ex. 6 | 5 | 0.68 | 0.73 | 300 |
| Ex. 7 | 5 | 0.68 | 0.73 | 260 |
| Ex. 8 | 5 | 0.70 | 0.77 | 220 |
| Ex. 9 | 5 | 0.70 | 0.78 | 200 |
| Ex. 10 | 5 | 0.72 | 0.78 | 380 |

TABLE 8-continued

| | Potential fluctuation (V) | Relative value of initial torque | Relative value of torque after 2,000 sheets are repeatedly output | Particle size (nm) |
|---|---|---|---|---|
| Ex. 11 | 8 | 0.70 | 0.80 | 350 |
| Ex. 12 | 8 | 0.72 | 0.78 | 420 |
| Ex. 13 | 5 | 0.68 | 0.77 | 370 |
| Ex. 14 | 10 | 0.65 | 0.70 | 590 |
| Ex. 15 | 8 | 0.68 | 0.74 | 540 |
| Ex. 16 | 8 | 0.70 | 0.77 | 550 |
| Ex. 17 | 5 | 0.70 | 0.79 | 510 |
| Ex. 18 | 10 | 0.68 | 0.74 | 580 |
| Ex. 19 | 8 | 0.70 | 0.75 | 530 |
| Ex. 20 | 5 | 0.72 | 0.80 | 470 |
| Ex. 21 | 10 | 0.65 | 0.71 | 610 |
| Ex. 22 | 13 | 0.65 | 0.70 | 630 |
| Ex. 23 | 10 | 0.68 | 0.73 | 550 |
| Ex. 24 | 10 | 0.70 | 0.74 | 500 |
| Ex. 25 | 10 | 0.68 | 0.76 | 550 |
| Ex. 26 | 15 | 0.63 | 0.68 | 670 |
| Ex. 27 | 13 | 0.65 | 0.70 | 650 |
| Ex. 28 | 10 | 0.73 | 0.80 | 250 |
| Ex. 29 | 5 | 0.75 | 0.85 | 230 |
| Ex. 30 | 5 | 0.78 | 0.86 | 240 |
| Ex. 31 | 5 | 0.78 | 0.88 | 220 |
| Ex. 32 | 5 | 0.83 | 0.88 | 180 |
| Ex. 33 | 5 | 0.85 | 0.90 | 150 |
| Ex. 34 | 8 | 0.80 | 0.85 | 220 |
| Ex. 35 | 5 | 0.83 | 0.89 | 200 |
| Ex. 36 | 25 | 0.62 | 0.67 | 760 |
| Ex. 37 | 20 | 0.65 | 0.71 | 610 |
| Ex. 38 | 30 | 0.62 | 0.69 | 740 |
| Ex. 39 | 25 | 0.65 | 0.70 | 670 |
| Ex. 40 | 13 | 0.68 | 0.74 | 420 |
| Ex. 41 | 12 | 0.70 | 0.75 | 330 |
| Ex. 42 | 10 | 0.72 | 0.77 | 260 |
| Ex. 43 | 8 | 0.63 | 0.68 | 370 |
| Ex. 44 | 8 | 0.65 | 0.70 | 270 |
| Ex. 45 | 10 | 0.65 | 0.70 | 270 |
| Ex. 46 | 10 | 0.68 | 0.73 | 260 |
| Ex. 47 | 8 | 0.70 | 0.77 | 220 |
| Ex. 48 | 5 | 0.70 | 0.78 | 200 |
| Ex. 49 | 5 | 0.72 | 0.78 | 380 |
| Ex. 50 | 13 | 0.70 | 0.80 | 350 |
| Ex. 51 | 13 | 0.72 | 0.78 | 420 |
| Ex. 52 | 10 | 0.65 | 0.70 | 320 |
| Ex. 53 | 10 | 0.62 | 0.68 | 540 |
| Ex. 54 | 10 | 0.65 | 0.70 | 490 |
| Ex. 55 | 12 | 0.68 | 0.75 | 500 |
| Ex. 56 | 10 | 0.70 | 0.79 | 510 |
| Ex. 57 | 13 | 0.68 | 0.74 | 580 |
| Ex. 58 | 13 | 0.70 | 0.75 | 530 |
| Ex. 59 | 10 | 0.72 | 0.80 | 470 |
| Ex. 60 | 13 | 0.65 | 0.71 | 610 |
| Ex. 61 | 15 | 0.62 | 0.68 | 610 |
| Ex. 62 | 15 | 0.68 | 0.73 | 550 |
| Ex. 63 | 15 | 0.70 | 0.74 | 500 |
| Ex. 64 | 15 | 0.65 | 0.73 | 500 |
| Ex. 65 | 20 | 0.63 | 0.68 | 670 |
| Ex. 66 | 18 | 0.65 | 0.70 | 650 |
| Ex. 67 | 13 | 0.70 | 0.75 | 200 |
| Ex. 68 | 8 | 0.75 | 0.85 | 230 |
| Ex. 69 | 8 | 0.78 | 0.86 | 240 |
| Ex. 70 | 5 | 0.78 | 0.88 | 220 |
| Ex. 71 | 8 | 0.83 | 0.88 | 180 |
| Ex. 72 | 5 | 0.85 | 0.90 | 150 |
| Ex. 73 | 13 | 0.80 | 0.85 | 220 |
| Ex. 74 | 10 | 0.83 | 0.89 | 200 |
| Ex. 75 | 28 | 0.62 | 0.67 | 760 |
| Ex. 76 | 25 | 0.65 | 0.71 | 610 |
| Ex. 77 | 30 | 0.62 | 0.69 | 740 |
| Ex. 78 | 28 | 0.65 | 0.70 | 670 |

TABLE 9

| | Potential fluctuation (V) | Relative value of initial torque | Relative value of torque after 2,000 sheets are repeatedly output | Particle size (nm) |
|---|---|---|---|---|
| Ex. 79 | 10 | 0.65 | 0.70 | 450 |
| Ex. 80 | 8 | 0.68 | 0.72 | 360 |
| Ex. 81 | 5 | 0.70 | 0.75 | 290 |
| Ex. 82 | 8 | 0.62 | 0.65 | 430 |
| Ex. 83 | 5 | 0.65 | 0.68 | 330 |
| Ex. 84 | 5 | 0.65 | 0.70 | 330 |
| Ex. 85 | 5 | 0.68 | 0.73 | 290 |
| Ex. 86 | 5 | 0.72 | 0.75 | 250 |
| Ex. 87 | 5 | 0.72 | 0.75 | 230 |
| Ex. 88 | 5 | 0.75 | 0.80 | 380 |
| Ex. 89 | 8 | 0.72 | 0.75 | 350 |
| Ex. 90 | 8 | 0.75 | 0.78 | 450 |
| Ex. 91 | 5 | 0.70 | 0.75 | 400 |
| Ex. 92 | 8 | 0.68 | 0.73 | 620 |
| Ex. 93 | 8 | 0.70 | 0.73 | 570 |
| Ex. 94 | 5 | 0.68 | 0.73 | 550 |
| Ex. 95 | 5 | 0.68 | 0.73 | 510 |
| Ex. 96 | 10 | 0.65 | 0.70 | 580 |
| Ex. 97 | 8 | 0.68 | 0.73 | 530 |
| Ex. 98 | 5 | 0.70 | 0.75 | 440 |
| Ex. 99 | 8 | 0.68 | 0.70 | 600 |
| Ex. 100 | 13 | 0.68 | 0.73 | 610 |
| Ex. 101 | 10 | 0.70 | 0.75 | 580 |
| Ex. 102 | 10 | 0.72 | 0.75 | 520 |
| Ex. 103 | 8 | 0.70 | 0.75 | 570 |
| Ex. 104 | 15 | 0.65 | 0.70 | 670 |
| Ex. 105 | 13 | 0.68 | 0.70 | 670 |
| Ex. 106 | 8 | 0.75 | 0.78 | 280 |
| Ex. 107 | 5 | 0.78 | 0.83 | 250 |
| Ex. 108 | 5 | 0.80 | 0.83 | 250 |
| Ex. 109 | 5 | 0.80 | 0.85 | 240 |
| Ex. 110 | 5 | 0.80 | 0.85 | 210 |
| Ex. 111 | 5 | 0.83 | 0.88 | 180 |
| Ex. 112 | 8 | 0.83 | 0.88 | 250 |
| Ex. 113 | 5 | 0.85 | 0.90 | 230 |
| Ex. 114 | 22 | 0.65 | 0.68 | 760 |
| Ex. 115 | 20 | 0.68 | 0.73 | 630 |
| Ex. 116 | 28 | 0.65 | 0.70 | 770 |
| Ex. 117 | 22 | 0.68 | 0.73 | 700 |
| Ex. 118 | 15 | 0.70 | 0.73 | 380 |
| Ex. 119 | 13 | 0.72 | 0.75 | 290 |
| Ex. 120 | 10 | 0.75 | 0.78 | 220 |
| Ex. 121 | 13 | 0.65 | 0.70 | 360 |
| Ex. 122 | 10 | 0.70 | 0.75 | 260 |
| Ex. 123 | 10 | 0.68 | 0.70 | 260 |
| Ex. 124 | 8 | 0.68 | 0.73 | 220 |
| Ex. 125 | 10 | 0.72 | 0.78 | 190 |
| Ex. 126 | 8 | 0.75 | 0.82 | 170 |
| Ex. 127 | 10 | 0.78 | 0.80 | 320 |
| Ex. 128 | 15 | 0.75 | 0.80 | 290 |
| Ex. 129 | 13 | 0.78 | 0.82 | 390 |
| Ex. 130 | 10 | 0.75 | 0.80 | 340 |
| Ex. 131 | 13 | 0.70 | 0.72 | 570 |
| Ex. 132 | 13 | 0.72 | 0.75 | 520 |
| Ex. 133 | 10 | 0.72 | 0.75 | 500 |
| Ex. 134 | 10 | 0.72 | 0.78 | 460 |
| Ex. 135 | 13 | 0.70 | 0.75 | 530 |
| Ex. 136 | 13 | 0.72 | 0.75 | 480 |
| Ex. 137 | 10 | 0.75 | 0.82 | 390 |
| Ex. 138 | 13 | 0.72 | 0.75 | 540 |
| Ex. 139 | 18 | 0.70 | 0.75 | 550 |
| Ex. 140 | 15 | 0.72 | 0.77 | 520 |
| Ex. 141 | 13 | 0.75 | 0.82 | 460 |
| Ex. 142 | 13 | 0.72 | 0.77 | 520 |
| Ex. 143 | 20 | 0.65 | 0.68 | 620 |
| Ex. 144 | 15 | 0.68 | 0.75 | 620 |
| Ex. 145 | 13 | 0.75 | 0.80 | 220 |
| Ex. 146 | 10 | 0.80 | 0.85 | 190 |
| Ex. 147 | 10 | 0.82 | 0.85 | 190 |
| Ex. 148 | 8 | 0.82 | 0.90 | 180 |
| Ex. 149 | 10 | 0.83 | 0.90 | 140 |
| Ex. 150 | 10 | 0.85 | 0.90 | 110 |

TABLE 9-continued

| | Potential fluctuation (V) | Relative value of initial torque | Relative value of torque after 2,000 sheets are repeatedly output | Particle size (nm) |
|---|---|---|---|---|
| Ex. 151 | 13 | 0.85 | 0.87 | 180 |
| Ex. 152 | 8 | 0.87 | 0.90 | 160 |
| Ex. 153 | 28 | 0.65 | 0.68 | 700 |
| Ex. 154 | 25 | 0.68 | 0.75 | 570 |
| Ex. 155 | 30 | 0.65 | 0.68 | 710 |
| Ex. 156 | 28 | 0.70 | 0.72 | 640 |

TABLE 10

| | Potential fluctuation (V) | Relative value of initial torque | Relative value of torque after 2,000 sheets are repeatedly output | Particle size (nm) |
|---|---|---|---|---|
| Comparative Example 1 | 5 | 0.90 | 0.95 | — |
| Comparative Example 2 | 8 | 0.95 | 0.97 | — |
| Comparative Example 3 | 8 | 0.90 | 0.95 | — |
| Comparative Example 4 | 5 | 0.93 | 0.95 | — |
| Comparative Example 5 | 5 | 0.93 | 0.97 | — |
| Comparative Example 6 | 8 | 0.90 | 0.93 | — |
| Comparative Example 7 | 10 | 0.90 | 0.95 | — |
| Comparative Example 8 | 13 | 0.93 | 0.97 | — |
| Comparative Example 9 | 13 | 0.90 | 0.95 | — |
| Comparative Example 10 | 10 | 0.90 | 0.93 | — |
| Comparative Example 11 | 8 | 0.90 | 0.95 | — |
| Comparative Example 12 | 13 | 0.90 | 0.95 | — |
| Comparative Example 13 | 20 | 0.90 | 0.93 | — |
| Comparative Example 14 | 140 | 0.65 | 0.70 | 950 |
| Comparative Example 15 | 170 | 0.65 | 0.70 | 1000 |
| Comparative Example 16 | 160 | 0.63 | 0.68 | 1000 |
| Comparative Example 17 | 150 | 0.65 | 0.68 | 1000 |
| Comparative Example 18 | 150 | 0.65 | 0.70 | 1050 |
| Comparative Example 19 | 160 | 0.68 | 0.73 | 1100 |
| Comparative Example 20 | 70 | 0.65 | 0.70 | 750 |
| Comparative Example 21 | 110 | 0.65 | 0.70 | 800 |
| Comparative Example 22 | 100 | 0.65 | 0.68 | 750 |
| Comparative Example 23 | 80 | 0.65 | 0.70 | 780 |
| Comparative Example 24 | 90 | 0.68 | 0.73 | 820 |
| Comparative Example 25 | 90 | 0.68 | 0.73 | 870 |
| Comparative Example 26 | 190 | 0.60 | 0.65 | — |
| Comparative Example 27 | 120 | 0.95 | 0.98 | — |
| Comparative Example 28 | 140 | 0.95 | 0.98 | — |
| Comparative Example 29 | 60 | 0.68 | 0.73 | 400 |
| Comparative Example 30 | 60 | 0.68 | 0.73 | 400 |
| Comparative Example 31 | 70 | 0.68 | 0.73 | 400 |
| Comparative Example 32 | 60 | 0.70 | 0.78 | 350 |
| Comparative Example 33 | 60 | 0.68 | 0.78 | 400 |
| Comparative Example 34 | 65 | 0.65 | 0.73 | 450 |
| Comparative Example 35 | 43 | 0.68 | 0.75 | 400 |
| Comparative Example 36 | 40 | 0.68 | 0.75 | 350 |
| Comparative Example 37 | 43 | 0.68 | 0.75 | 400 |
| Comparative Example 38 | 40 | 0.65 | 0.73 | 450 |
| Comparative Example 39 | 42 | 0.68 | 0.73 | 300 |
| Comparative Example 40 | 40 | 0.65 | 0.70 | 360 |
| Comparative Example 41 | 60 | 0.70 | 0.75 | 500 |
| Comparative Example 42 | 65 | 0.75 | 0.80 | 520 |
| Comparative Example 43 | 70 | 0.75 | 0.82 | 470 |
| Comparative Example 44 | 65 | 0.72 | 0.78 | 550 |
| Comparative Example 45 | 65 | 0.75 | 0.80 | 470 |
| Comparative Example 46 | 75 | 0.75 | 0.82 | 500 |
| Comparative Example 47 | 110 | 0.83 | 0.90 | — |

From the comparison of Examples with Comparative Examples 1 to 12, if the polycarbonate resin having the siloxane moiety in the charge-transporting layer has a low siloxane content, a reducing effect on the contact stress is not sufficiently obtained. This is shown by no reducing effect on the torque found in the initial torque and the torque after 2,000 sheets are repeatedly output in the evaluation method. In Comparative Example 13, if the polycarbonate resin having the siloxane moiety has a low siloxane content, it is shown that increase in the content of the siloxane-containing resin in the charge-transporting layer does not lead to a sufficient relaxing effect on the contact stress.

From the comparison of Examples with Comparative Examples 14 to 25, the polycarbonate resin having the siloxane moiety in the charge-transporting layer has a high siloxane content, the potential stability in repeating use are remarkably poor. In this case, while the matrix-domain structure is formed by the polycarbonate resin having the siloxane moiety, the polycarbonate resin and the charge-transporting layer excessively contain the siloxane structure, leading to insufficient compatibility with the charge-transporting substance. For this reason, a sufficient potential stability in repeating use is not obtained. In Comparative Example 26, the potential stability in repeating use is insufficient as well. In the result of Comparative Example 26, the matrix-domain structure is not formed, and large potential fluctuation occurs. Namely, in Comparative Examples 14 to 26, it is thought that compatibility with the charge-transporting substance is insufficient in the case where the charge-transporting substance and the resin excessively containing the siloxane structure are contained.

From the comparison of Examples with Comparative Examples 27 and 28, if the polycarbonate resin having the siloxane moiety in the charge-transporting layer has a crosslinking structure and does not form the matrix-domain structure, a relaxing effect on the contact stress is not sufficiently obtained.

From the comparison of Examples with Comparative Examples 29 to 34, the potential stability may be poor in the charge-transporting substance shown in the present invention even if the matrix-domain structure is formed using the resin having the siloxane structure. Moreover, the comparison of Examples with Comparative Examples 29 to 34 shows that use of the polycarbonate resin according to the present invention improves the potential stability in repeating use. In this case, it also shows that in Examples, a sufficient potential stability can be compatible with a persistent relaxing effect on the contact stress. In Comparative Examples 29 to 34, the component γ having high compatibility with the resin in the charge-transporting layer contains a large amount of the charge-transporting substance in the domain of the siloxane-containing resin. As a result, the charge-transporting substance is aggregated in the domain, leading to insufficient potential stability. In Examples, however, it is thought that the content of the charge-transporting substance in the domain is reduced because the compatibility of the component α with the component γ in the present invention is low. For this reason, it is thought that the content of the charge-transporting substance in the domain that causes the potential fluctuation is reduced, and high potential stability is demonstrated. The results of Comparative Examples 35 to 40 also suggest that the compatibility of the component α with the component γ improves the potential stability in repeating use. From the comparison of Comparative Examples 29 to 34 with Examples, in the case where the charge-transporting layer containing the components α and γ according to the present invention is formed, a remarkable suppressing effect on the potential fluctuation is obtained.

The comparison of Examples with Comparative Examples 41 to 46 shows that the potential stability is insufficient if the siloxane moiety has an aryl group in the case where the matrix-domain structure is formed using the polycarbonate resin having the siloxane moiety in the charge-transporting layer. The result of Comparative Example 47 shows that the potential stability in repeating use is insufficient if the siloxane moiety has an aryl group even in the case where the charge-transporting substance and the resin having a proper amount of the siloxane structure are contained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-231812, filed Oct. 14, 2010, which is hereby incorporated by reference herein in its entirety.

The invention claimed is:

1. An electrophotographic photosensitive member, comprising:

a conductive support, a charge-generating layer which is provided on the conductive support and comprises a charge-generating substance, and a charge-transporting layer which is provided on the charge-generating layer and is a surface layer of the electrophotographic photosensitive member;

wherein the charge-transporting layer has a matrix-domain structure having:

a domain which comprises a polycarbonate resin A having a repeating structural unit represented by the following formula (A) and a repeating structural unit represented by the following formula (B); and a matrix which comprises, at least one resin selected from the group consisting of a polycarbonate resin C having a repeating structural unit represented by the following formula (C) and a polyester resin D having a repeating structural unit represented by the following formula (D), and at least one charge-transporting substance selected from the group consisting of a compound represented by the following formula (1) and a compound represented by the following formula (1');

wherein the content of a siloxane moiety in the polycarbonate resin A is not less than 5% by mass and not more than 40% by mass relative to the total mass of the polycarbonate resin A;

(A)

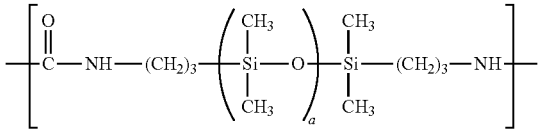

wherein, in the formula (A), "a" represents number of repetitions of a structure within the bracket, an average of "a" in the polycarbonate resin A ranges from 20 to 200;

(B)

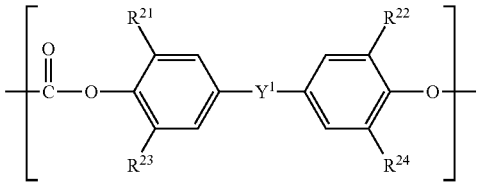

wherein, in the formula (B), $R^{21}$ to $R^{24}$ each independently represents a hydrogen atom, or a methyl group, and $Y^1$ represents a single bond, a methylene group, an ethylidene group, a propylidene group, a phenylethylidene group, a cyclohexylidene group, or an oxygen atom;

(C)

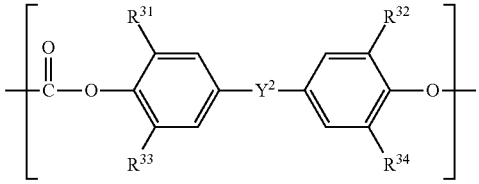

wherein, in the formula (C), $R^{31}$ to $R^{34}$ each independently represents a hydrogen atom, or a methyl group, and $Y^2$ represents a single bond, a methylene group, an ethylidene group, a propylidene group, a phenylethylidene group, a cyclohexylidene group, or an oxygen atom;

(D)

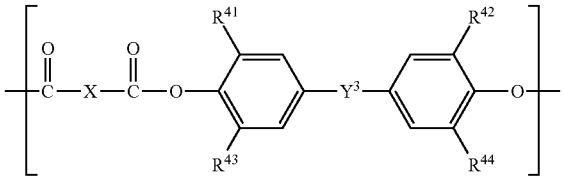

wherein, in the formula (D), $R^{41}$ to $R^{44}$ each independently represents a hydrogen atom, or a methyl group, X represents a meta-phenylene group, a para-phenylene group, or a bivalent group having two para-phenylene groups bonded via an oxygen atom, and $Y^3$ represents a single bond, a methylene group, an ethylidene group, a propylidene group, a cyclohexylidene group, or an oxygen atom;

(1)

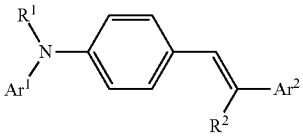

-continued (1')

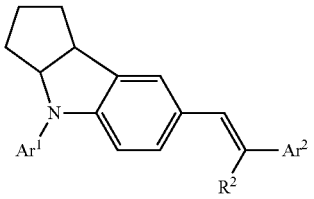

wherein, in the formulae (1) and (1'), $Ar^1$ represents a phenyl group, or a phenyl group substituted with a methyl group or an ethyl group, $Ar^2$ represents a phenyl group, a phenyl group substituted with a methyl group, a phenyl group substituted with a univalent group representing the formula "—CH═CH—Ta", or a biphenyl group substituted with a univalent group represented by the formula "—CH═CH—Ta" (where, Ta represents a univalent group derived from a benzene ring of a triphenylamine by loss of one of the hydrogen atom, or derived from a benzene ring of a triphenylamine substituted with a methyl group or an ethyl group by loss of one of the hydrogen atom), $R^1$ represents a phenyl group, a phenyl group substituted with a methyl group, or a phenyl group substituted with a univalent group represented by the formula "—CH═($Ar^3$)$Ar^4$" (where, $Ar^3$ and $Ar^4$ each independently represents a phenyl group or a phenyl group substituted with a methyl group), and $R^2$ represents a hydrogen atom, a phenyl group, or a phenyl group substituted with a methyl group.

2. An electrophotographic photosensitive member according to claim 1, wherein the content of the siloxane moiety in the charge-transporting layer is not less than 1% by mass and not more than 20% by mass relative to the total mass of whole resins in the charge-transporting layer.

3. An electrophotographic photosensitive member according to claim 1, wherein, in the formula (A), the average of "a" in the polycarbonate resin A ranges from 30 to 100.

4. A process cartridge detachably attachable to a main body of an electrophotographic apparatus, wherein the process cartridge integrally supports:

the electrophotographic photosensitive member according to claim 1, and at least one device selected from the group consisting of a charging device, a developing device, a transferring device, and a cleaning device.

5. An electrophotographic apparatus, comprising:

the electrophotographic photosensitive member according to claim 1; a charging device; an exposing device; a developing device; and a transferring device.

6. A method of manufacturing the electrophotographic photosensitive member according to claim 1, wherein the method comprises a step of forming the charge-transporting layer by applying a charge-transporting-layer coating solution on the charge-generating layer, and wherein the charge-transporting-layer coating solution comprises:

the polycarbonate resin A, at least one resin selected from the group consisting of the polycarbonate resin C and the polyester resin D, and at least one charge-transporting substance selected from the group consisting of a compound represented by the formula (1) and a compound represented by the formula (1').

* * * * *